US007937780B2

(12) United States Patent
Matic et al.

(10) Patent No.: US 7,937,780 B2
(45) Date of Patent: May 10, 2011

(54) EXTREMITY ARMOR

(75) Inventors: Peter Matic, Alexandria, VA (US); Graham K Hubler, Highland, MD (US); James A Sprague, Santa Fe, NM (US); Nevin Rupert, Edgewood, MD (US); Kirth E Simmonds, Clinton, MD (US); Richard Steven Bruno, Aberdeen, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 462 days.

(21) Appl. No.: 12/118,113

(22) Filed: May 9, 2008

(65) Prior Publication Data

US 2008/0295210 A1 Dec. 4, 2008

Related U.S. Application Data

(63) Continuation of application No. 11/298,283, filed on Dec. 9, 2005, now abandoned.

(60) Provisional application No. 60/634,533, filed on Dec. 10, 2004.

(51) Int. Cl.
*A41D 27/26* (2006.01)

(52) U.S. Cl. ..... 2/465

(58) Field of Classification Search ..... 2/16, 459, 2/465, 94, 108, 2.5, 272, 79, 129
See application file for complete search history.

(56) References Cited

U.S. PATENT DOCUMENTS

| | | | |
|---|---|---|---|
| 4,181,768 | A | 1/1980 | Severin |
| 4,183,097 | A | 1/1980 | Mellian |
| 4,522,871 | A | 6/1985 | Armellino, Jr. et al. |
| 4,530,111 | A | 7/1985 | Barron et al. |
| 4,535,478 | A | 8/1985 | Zufle |
| 4,578,821 | A | 4/1986 | Zufle |
| 4,660,223 | A | 4/1987 | Fritch |
| 4,680,812 | A | 7/1987 | Weigl et al. |
| 4,850,050 | A | 7/1989 | Droste et al. |
| 4,989,266 | A | 2/1991 | Borgese et al. |
| 5,044,011 | A | 9/1991 | Henderson |
| 5,073,985 | A | 12/1991 | Stone et al. |
| 5,087,516 | A | 2/1992 | Groves et al. |
| 5,157,792 | A | 10/1992 | Allen et al. |
| 5,179,244 | A | 1/1993 | Zufle |
| 5,180,880 | A | 1/1993 | Zufle |
| 5,306,557 | A | 4/1994 | Madison |
| 5,331,683 | A | 7/1994 | Stone et al. |
| 5,373,582 | A | 12/1994 | Dragone et al. |

(Continued)

OTHER PUBLICATIONS

"Conventional Rifle Protection", www.pinnaclearmor.com/body-armor/plates.php.

(Continued)

*Primary Examiner* — Tejash Patel
(74) *Attorney, Agent, or Firm* — Amy Ressing; Roy Roberts

(57) ABSTRACT

Body armor for ballistic protection of a user's extremities preferably comprising right and left arm protection units and/or right and left leg protection units. The units include a ballistic protection material which preferably covers most of the user's upper arm, elbow region, lower arm, shoulder, upper leg, knee region, and lower leg except for ventilation zones preferably located on the inner portion of the upper arm and the inner part of the upper leg. The back of the knee is preferably covered by a protective flap.

24 Claims, 26 Drawing Sheets

U.S. PATENT DOCUMENTS

| | | | | |
|---|---|---|---|---|
| 5,471,906 | A | 12/1995 | Bachner, Jr. et al. | |
| 5,472,769 | A | 12/1995 | Goerz, Jr. et al. | |
| 5,495,620 | A | 3/1996 | Schoenweiss et al. | |
| 5,495,621 | A | 3/1996 | Kibbee | |
| 5,669,072 | A | 9/1997 | Bjorklund | |
| 5,697,098 | A | 12/1997 | Miguel-Bettencourt et al. | |
| 5,796,028 | A | 8/1998 | Field et al. | |
| 5,804,757 | A | 9/1998 | Wynne | |
| 5,970,513 | A | 10/1999 | Kocher | |
| 5,996,115 | A | 12/1999 | Mazelsky | |
| 6,012,162 | A | 1/2000 | Bullat | |
| 6,035,438 | A | 3/2000 | Neal et al. | |
| 6,098,196 | A | 8/2000 | Logan | |
| 6,119,575 | A | 9/2000 | Dragone et al. | |
| 6,170,378 | B1 | 1/2001 | Neal et al. | |
| 6,276,255 | B1 | 8/2001 | Field et al. | |
| 6,370,690 | B1 | 4/2002 | Neal | |
| 6,418,832 | B1 | 7/2002 | Colvin | |
| D468,061 | S | 12/2002 | Leahy et al. | |
| D475,138 | S | 5/2003 | Baura et al. | |
| D476,793 | S | 7/2003 | Leahy et al. | |
| 6,605,334 | B2 | 8/2003 | Bettencourt | |
| 6,651,543 | B2 | 11/2003 | Park | |
| 6,681,400 | B1 | 1/2004 | Mills | |
| 6,687,912 | B2 | 2/2004 | Collins et al. | |
| 6,698,024 | B2 | 3/2004 | Graves et al. | |
| 6,705,197 | B1 | 3/2004 | Neal | |
| 6,738,984 | B2 * | 5/2004 | Gillen et al. | 2/2.5 |
| 6,745,661 | B1 | 6/2004 | Neal et al. | |
| D504,980 | S | 5/2005 | Le Carpentier et al. | |
| 6,892,392 | B2 | 5/2005 | Crye et al. | |
| 6,922,847 | B2 | 8/2005 | Bachner, Jr. | |
| 7,010,811 | B1 | 3/2006 | Park | |
| 7,076,806 | B1 | 7/2006 | Van Winkle et al. | |
| 7,100,490 | B2 | 9/2006 | Muller, Jr. | |
| 7,150,217 | B2 | 12/2006 | Kershaw et al. | |
| 2002/0132089 | A1 | 9/2002 | Bettencourt | |
| 2003/0056271 | A1 | 3/2003 | Graves et al. | |
| 2003/0151152 | A1 | 8/2003 | Nichelson et al. | |
| 2003/0188631 | A1 | 10/2003 | Park | |
| 2004/0016036 | A1 | 1/2004 | Bachner | |
| 2005/0010987 | A1 | 1/2005 | Crye et al. | |
| 2005/0011347 | A1 | 1/2005 | Muller | |
| 2005/0193481 | A1 | 9/2005 | Hatfield et al. | |
| 2006/0037121 | A1 | 2/2006 | Park | |

OTHER PUBLICATIONS

"Modular Tactical Vest (MTV)", Protective Products International, www.body-armor.com.

"Introducing Vortex, Law Enforcement Tactical", First Choice Armor, Press release dated Mar. 28, 2007, pp. 1-2 and pp. 1-4, www.firstchoicearmor.com.

"BlackHawk S.T.I.K.E. Cutaway Tactical Armor Vest", Bullet Proof ME Body Armor, http://www.bulletproofme.com/PHOTO%20pages/BlackHawk-Tactical-Vest.htm.

* cited by examiner

EXTREMITY ARMOR

CROSS-REFERENCE TO RELATED APPLICATION

This application is a continuation of U.S. patent application Ser. No. 11/298,283 filed on Dec. 9, 2005, which claims priority to U.S. Provisional Patent Application No. 60/634,533filed Dec. 10, 2004, the disclosures of which are incorporated herein in full by reference.

FIELD OF THE INVENTION

The present invention relates to body armor systems for ballistic protection of a user's extremities.

BACKGROUND OF THE INVENTION

The introduction of the outer tactical vest (OTV) with ceramic plates has shifted the apparent injury pattern of soldiers to make limb amputation more common. The superb effectiveness of the torso armor results in the survival of soldiers who, without the OTV, would have been killed. However, due to the closer proximity to the blast, the arms and legs are vulnerable. This situation was not anticipated so there does not exist today any total limb protection option for the foot soldier.

There have been several partial options fielded just since June 2004, such as an underarm protector and shoulder protector. The US Army is fielding this option. The US Marine Corps has fielded upper leg protectors, and has also fielded a limited number of armored shorts to protect 50 mm gunners on HMWVV's. None of these options offers complete arm and leg protection. The upper arm, lower arm, elbow, knee and lower leg are not addressed at all by these units.

There exist many body armor options for law enforcement personnel including SWAT teams. These items generally are only for frontal assault, short time encounters. As a result, they are not designed for comfort factors like heat, long-time wear, mobility, flexibility, and the like. Moreover, the threat to the soldier is 360 degrees, as opposed to merely the frontal assault, so the SWAT team options leave the rear vulnerable.

There also exist many options from the bomb disposal community in the Department of Defense and law enforcement sectors. This equipment has a very high degree of frontal protection but is very heavy, hot and cumbersome, and not suitable for the foot soldier. There is no suitable product available for foot soldiers to protect the extremities from the fragments of explosives. Nor has there been any limb armor heretofore designed from the standpoint of anatomical facts and injury statistics for the purpose of reducing amputation from explosion.

SUMMARY OF THE INVENTION

The present invention satisfies the needs and alleviates the problems discussed above. In one aspect, there is provided a body armor system for ballistic protection of a user's extremities comprising a right arm protection unit and a left arm protection unit, wherein each of the arm protection units includes a ballistic protection material and has an upper arm section which preferably comprises at least a portion of the ballistic protection material positioned to cover a front portion, a back portion, and an outer portion of the user's upper arm. The upper arm section also preferably includes an upper arm ventilation zone which will be positioned on the inner portion of the user's upper arm adjacent to the user's torso and which does not include any of the ballistic protection material. The portion of the ballistic protection material provided in the upper arm section will preferably extend at least 270 degrees around the user's upper arm and will most preferably extend in the range of from about 270 degrees to about 300 degrees around the user's upper arm.

Terms such as "front," "back," "outer side," "inner," etc. used herein and in the claims for identifying portions of the user's arms and legs are in referenced to the position of the user's arms and legs when standing erect such that the user's arms are hanging in natural position adjacent to the sides of the user's torso.

In another aspect, there is provided a body armor system for ballistic protection of a user's extremities comprising a right arm protection unit and a left arm protection unit wherein each of the arm protection units includes a ballistic protection material and has a lower arm section which preferably comprises at least a portion of the ballistic protection material positioned to cover at least a front portion, an outer portion, and an inner portion of the user's lower arm. The portion of the ballistic protection material in the lower arm section will preferably extend at least 270 degrees around the user's lower arm and will most preferably extend about 360 degrees around the user's lower arm. The lower arm section can also optionally include a lower arm ventilation zone which will be positioned on a back portion of the user's lower arm and which does not include any of the ballistic protection material.

In another aspect, the inventive arm protection units preferably comprise both upper arm and lower arm sections and preferably further comprise another portion of the ballistic protection material which is positioned to extend about 360 degrees around the elbow region of the user. In addition, the upper arm section preferably further comprises an upper arm fabric sleeve section and the lower arm section preferably further comprises a lower arm fabric sleeve section. The portion of the ballistic protection material in the upper arm section is preferably a first insert which is held by the upper arm fabric sleeve section. The portion of the ballistic protection material in the lower arm section is preferably a second insert, separate from the first insert, which is held by the lower arm fabric sleeve section.

In another aspect, there is provided a body armor system for ballistic protection of a user's extremities comprising a right arm protection unit and a left arm protection unit, wherein each of the arm protection units comprises (a) an upper section which is positionable on a user's upper arm and includes an upper section ballistic protection material and (b) a lower section which includes a lower section ballistic protection material and is removably attachable to the upper section such that the lower section is positionable on a user's lower arm.

In another aspect, there is provided a body armor system for ballistic protection of a user's extremities comprising a right leg protection unit and a left leg protection unit, wherein each of the leg protection units includes ballistic protection material and has an upper leg section which comprises at least a portion of the ballistic protection material positioned to cover at least a front portion and a back portion of the user's upper leg. The upper leg section also includes an upper leg ventilation zone which will be positioned on an inner portion of the user's upper leg adjacent to the user's other leg and which does not include any of the ballistic protection material. The portion of the ballistic material in the upper leg section will preferably extend at least 270 degrees around the user's upper leg and will most preferably extend in the range from about 270 degrees to about 300 degrees around the user's upper leg.

In another aspect, there is provided a body armor system for ballistic protection of a user's extremities comprising a right leg protection unit and a left leg protection unit, wherein each of the leg protection units includes ballistic protection material and has a lower leg section which comprises at least a portion of the ballistic protection material positioned to cover at least an outer side portion, an inner portion, and a back portion of the user's lower leg. The portion of ballistic protection material in the lower leg section will preferably extend at least 270 degrees around the user's lower leg and will most preferably extend about 360 degrees around the user's lower leg. Alternatively, the lower leg section can optionally include a lower leg ventilation zone which will be positioned on a front portion of the user's lower leg over the user's shin bone and which does not include any of the ballistic protection material.

In another aspect, each of the leg protection units preferably further comprises a knee section including another portion of the ballistic protection material positioned to cover a front portion, an outer portion, and an inner portion of the knee region of the user. In addition, each of the leg protection units preferably includes a flap which includes another portion of the ballistic protection material which will be positioned over a back portion of the knee region of the user.

In another aspect, there is provided a body armor system for ballistic protection of a user's extremities comprising a right leg protection unit and a left leg protection unit, wherein each of the leg protection units comprises (a) an upper section which is positionable on a user's upper leg and includes an upper section ballistic protection material and (b) a lower section which includes a lower section ballistic protection material and is removably attachable to the upper section such that the lower section is positionable on a user's lower leg.

Further aspects, features, and advantages of the present of invention will be apparent to those in the art upon examining the accompanying drawings and upon reading the following detailed description of the preferred embodiments.

DETAILED DESCRIPTION OF THE PREFERRED EMBODIMENTS

Figure 1:
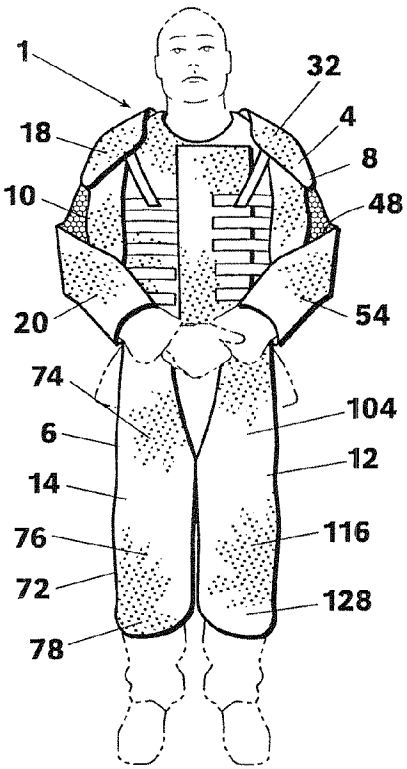
FIG. 1 is a front view of an embodiment 1 of the inventive extremity armor system.

The inventive extremity protection system design is the result of exhaustive trade-off studies of the anatomically most vulnerable limb areas that, when damaged, cause amputation, weight (and therefore ballistic performance), degree of coverage, flexibility, total body cooling, and appearance. Important design criteria in this effort included wearability, issues of body cooling in desert use, weight and comfort. These issues led to the armor being designed with open areas. The location of major sweat glands was also an important factor in the positioning of open areas. The design principles to handle these areas were formulated from anatomical facts and injury statistics.

In some embodiments, the inventive system uses the bone as part of the protection system. Where possible, an area left open for ventilation is where the bone is near the skin surface. This provides protection for the more vulnerable vascular and nerve systems deeper into the limb and on the far side of the bone.

The inventive system also uses shadowing to protect uncovered areas. Zones inside the legs and under the arms are left open due to the location of major sweat glands. However, major vascular and nerve bundles are also located there that need protection. The concept of shadowing is effective for the arms when the upper arm is hanging at one's side. The inner arm is protected by the armor covering preferably at least the outer 270 degrees of the arm and the user's torso on the other side. The under arm is vulnerable when the arm is raised. This shadowing also provides partial protection of the torso from bomb fragments. So this concept provides protection, depending upon the arm position and the specific scenario of operation. Similarly, the inner leg is protected by shadowing when in the standing position by the armor on the opposite leg, and the armor on the outer part of the same leg. So this concept also provides protection to the femoral arteries in the inner leg, depending upon the leg position and the specific scenario of operation.

The inventive system preferably implements complete, 360-degree protection of the elbow and knee, while maintaining flexibility of these joints. The elbow and knee are particularly important to protect in order to prevent amputation. In addition, in some embodiments, the inventive system preferably provides 360 degree protection for the lower arm and the lower leg.

The inventive system preferably further provides: protection of the shoulder joint and partial protection of the hip joint, that also are important to prevent amputation; 100% coverage of the sciatic nerve where injury statistics show that legs that survive amputation are often useless due to impairment of the sciatic nerve; the use of open or openable areas on the sides for access to pockets and cargo pockets important for the mission of the soldier; and the use of two-way zippers on the sides of the pant legs for added cooling when needed and/or for ease of putting on over the boot.

The arm protection units are preferably adapted to be worn over a standard USMC Combat Utility uniform or Battle Dress Uniform (BDU). The arm protection units preferably provide ballistic protection for approximately 300 degrees on the upper arms, at least 300 degrees on the lower arms, and 360 degrees in the elbow regions. The remaining approximately 60 degrees of each upper arm is preferably covered with a mesh fabric or perforated fabric to provide ventilation. The mesh area ventilation zone on the upper arm is toward the body. On the other hand, any ventilation zone on the lower arm, if provided, will preferably be on the back of the arm when the arm is held at the individual's side.

The components protecting the right and left arm can be joined into a single unit by one or more straps or other devices fitting across the individual's back.

The arm protection units provide for flexible movement of each arm from a straight position to at least a normal rifle firing position. The ballistic material can be sewn into the covering fabric. Alternatively, pockets can be used to hold removable ballistic protection to allow for laundering.

Examples of suitable ballistic protection materials are mentioned below. The ballistic material preferably comprises from about 15 to about 30 layers of an appropriate ballistic material, most preferably, Dyneema®. Each layer of ballistic material preferably contains one 0 degree and one 90 degree ply, i.e. (0-90) degrees. The layers of ballistic material are preferably cut, oriented, and stacked in the same direction to ensure that the ply lay-up across any two layers is a (0-90)-(0-90) degrees plies. Any suitable ballistic material or combination of materials may be used to advantage with the novel pattern design of the armor. The layered ballistic materials used in the present invention can be quilted but will more preferably be held together using minimal perimeter stitching.

The leg protection units can be worn alone and are preferably adapted to be worn over a standard USMC or Army combat utility uniform or Battle Dress Uniform (BDU). The leg protection units preferably provide ballistic protection for approximately 300 degrees on the upper leg, at least 300 degrees on the lower leg, and 360 degrees in the knee regions. The remaining 60 degrees of the upper leg will preferably be covered with a mesh fabric or perforated fabric to provide ventilation. The mesh area ventilation zone on the upper leg is preferably positioned between the legs. Any ventilation zone on the lower leg, if provided, will preferably be over the shinbone.

The components protecting the right and left legs are preferably joined at the top to form a single pants unit designed to be worn alone or with the standard USMC or Army combat utility uniform and can optionally include suspenders.

The leg protection units provide for flexible movement of the legs from a normal standing position to a fully squatting position. The ballistic material can be sewn into the covering fabric. Alternatively, pockets can be used to hold removable ballistic material to allow for laundering.

Examples of suitable ballistic protection materials for the leg are mentioned below. The ballistic material preferably comprises from approximately 15 to approximately 30 layers of an appropriate ballistic material, most preferably Dyneema®. Each layer of ballistic material contains one 0 degree and one 90 degree ply, i.e. (0-90) degrees. The layers of ballistic material are preferably cut, oriented, and stacked in the same direction to ensure that the ply lay-up across any two layers is a (0-90)-(0-90) degrees plies. Any suitable ballistic material or combination of materials may be used to advantage with the novel pattern design of the armor. The layered ballistic materials used in the present invention can be quilted but will more preferably be held together using minimal perimeter stitching.

In addition to use by soldiers, the body armor may be useful for foot patrols, SWAT-type operations for penetrating buildings, sentry duty, bomb disposal, convoy duty, 50 caliber machine gun operators, and many other applications.

The total body armor units provide protection from blast and bomb fragments for approximately 85% or more of the limbs, including the upper and lower arm, shoulder, elbow, upper and lower leg, knee and hip. The unit design is the result of exhaustive trade-off studies of factors such as the anatomically most vulnerable limb areas (that when damaged cause amputation), weight of the armor system (and therefore ballistic performance), degrees of coverage, flexibility, total body cooling, and appearance. All other available limb armor options provide, at best, only 20% coverage of the limbs.

The arm units can include any or all of the following features: adaptability for integration with an Outer Tactical Vest (OTV) and/or other vests or systems; light weight (approximately 1.3 lbs/arm); flexible elbow and shoulder designs that do not impede weapon aiming or firing; open areas or overlap areas for cooling under the arm, behind the elbow, and at the top of the shoulder; at least 270 degree (more preferably approximately 300 degree) protection from the shoulder to the top of the elbow; approximately 360 degree protection around the elbow; at least 270 degree (more preferably at least 300 degree and most preferably approximately 360 degree) protection below the elbow to the wrist; protection of anatomically critical vulnerable areas such as vascular/nerve bundles inside the elbow, the shoulder and under the armpit; approximately double armor protection over small areas at the elbow and the shoulder; removable ballistic material for cleaning of the outer camouflage material; and ease of manufacture.

The leg units can include any or all of the following features: adaptability for integration with an OTV and/or other vests or systems; light weight (approximately 3.2 lbs/leg); a flexible knee design that does not impede squatting to a rifle aiming position, running or jumping; open areas or overlap areas for cooling at the groin, inside the thighs, at the hips, behind the knee, and optionally at the lower shin; two-way zippered lower legs for ease of donning and for extra cooling when needed; approximately double armor protection over most of the area behind the knee; at least 200 degree protection around the waist; at least 270 degree (more preferably approximately 300 degree) protection around the thighs; approximately 360 degree protection around the knees and the majority of the lower legs; complete protection of anatomically critical points such as the vascular/nerve bundles behind the knee and the sciatic nerve extending from the lower back, down the buttocks to rear of the thigh; complete protection of the femoral artery area inside the thigh when the groin protector issued with OTV is worn; side and cargo pockets which are easily accessible; an anti-chaffing design provided at the shin; removable ballistic material for cleaning of the camouflage material; and ease of manufacture.

Any suitable ballistic material or combination thereof can be selected from many of the commercially available soft armor products. These include, but are not limited to, Dyneema, Twaron, Kevlar, Spectra, and Zylon. Additionally, hard versions of the soft armor products may be used, or hybrid versions. The degree of ballistic protection may be increased or decreased within the same clothing pattern, with a concomitant increase or decrease, respectively, in weight. The inventive design provides heat dissipation and is appropriate for desert heat. As will be apparent, versions of the inventive extremity armor for other, cooler climates could increase the area of protection to greater than 85% of the extremities by changing the material dimensions.

Figure 2:
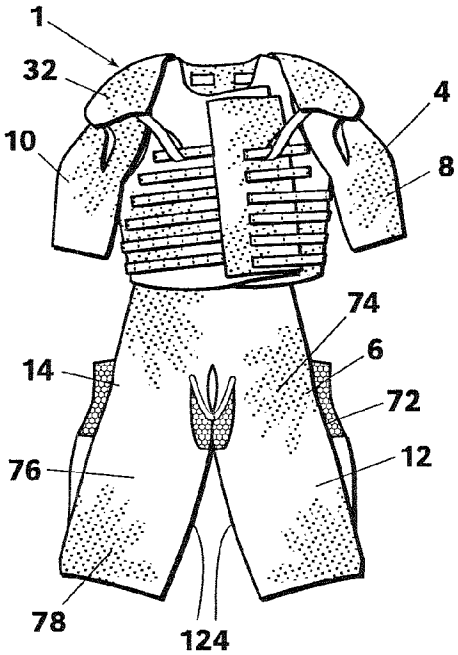
FIG. 2 is another front view of the inventive extremity armor system 1.
Figure 3:
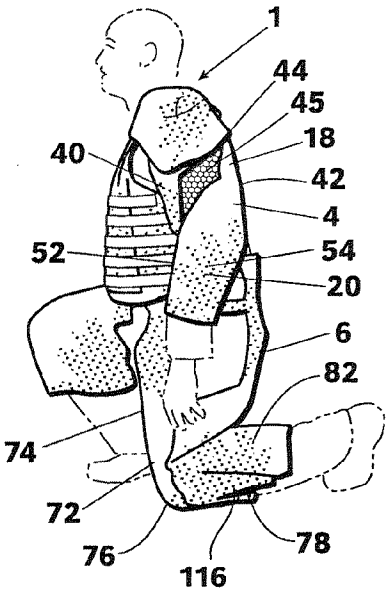
FIG. 3 is a side kneeling view of the inventive extremity armor system 1.
Figure 4:
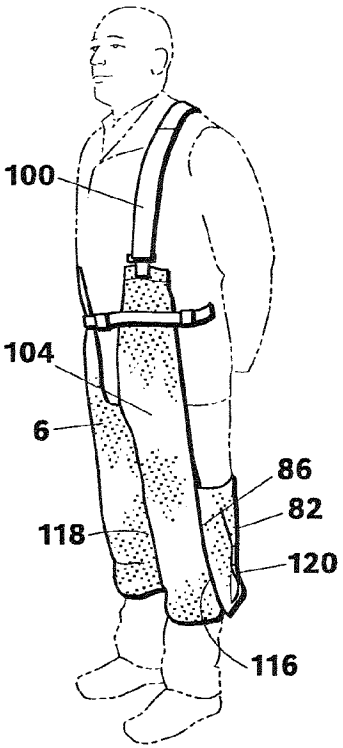
FIG. 4 is a ¾ side view of a lower extremity protection portion 6 of inventive system 1.
Figure 6:
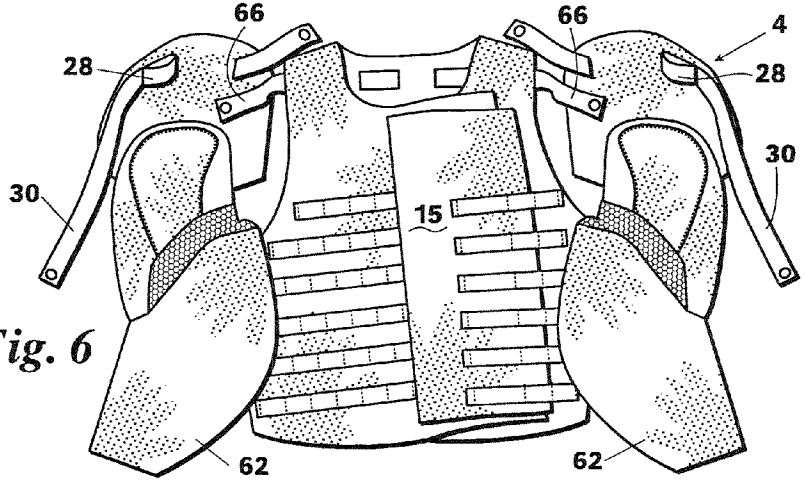
FIGS. 6 and 7 are front views illustrating the attachment of the upper extremity protection system 4 to an outer tactical vest 15.
Figure 7:
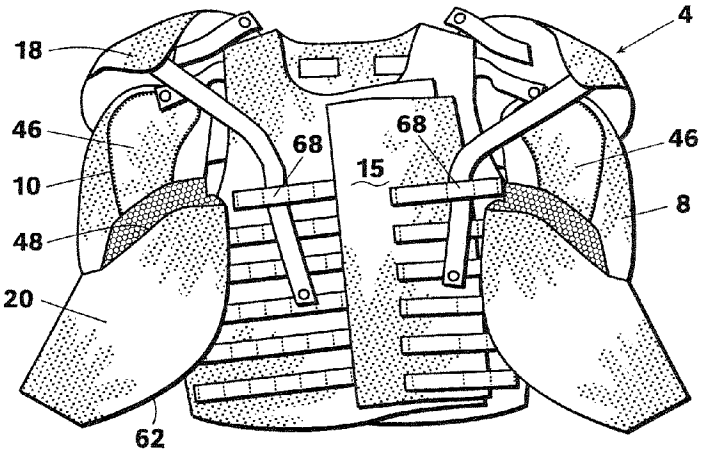
Figure 5:
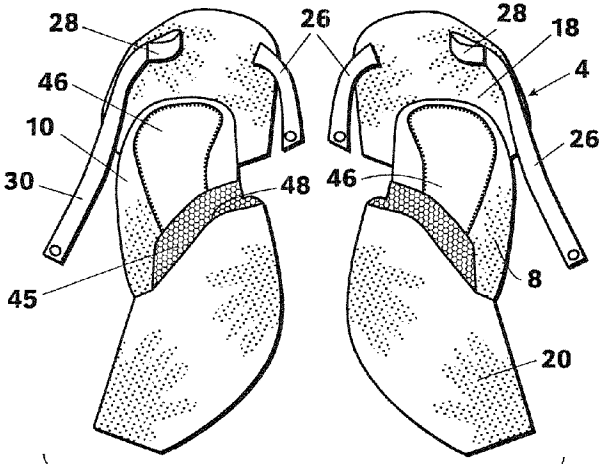
FIG. 5 is a front view of an upper extremity protection system 4.
Figure 8:
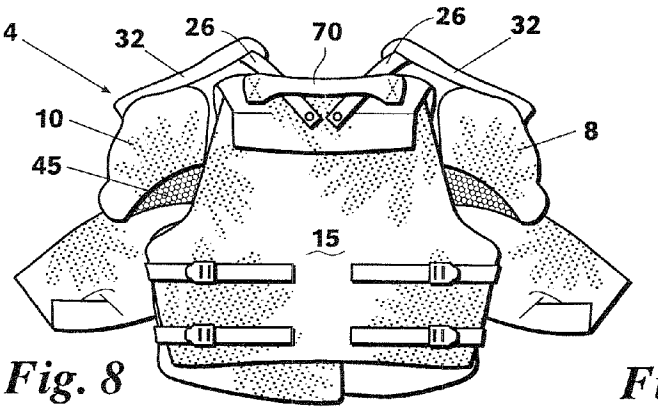
FIG. 8 is a back view illustrating the attachment of the upper extremity protection system 4 to the vest 15.
Figure 10:
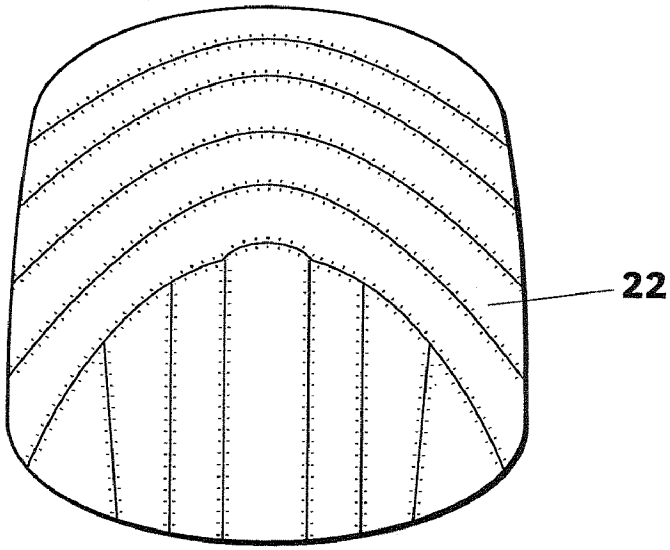
FIG. 10 is a front view of a shoulder ballistic protection material insert 22 for the upper extremity protection system 4.
Figure 9:
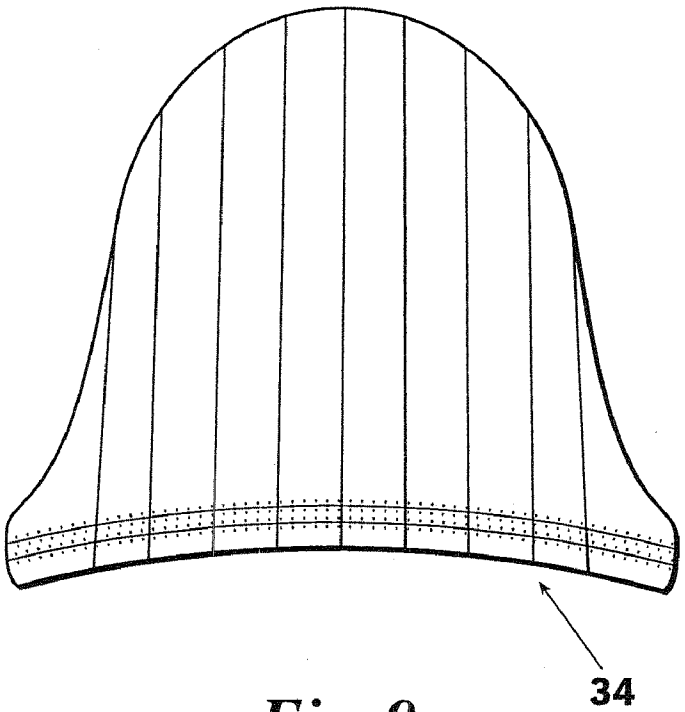
FIG. 9 is a front view of an upper arm ballistic protection insert 34 for the upper extremity protection system 4.
Figure 11:
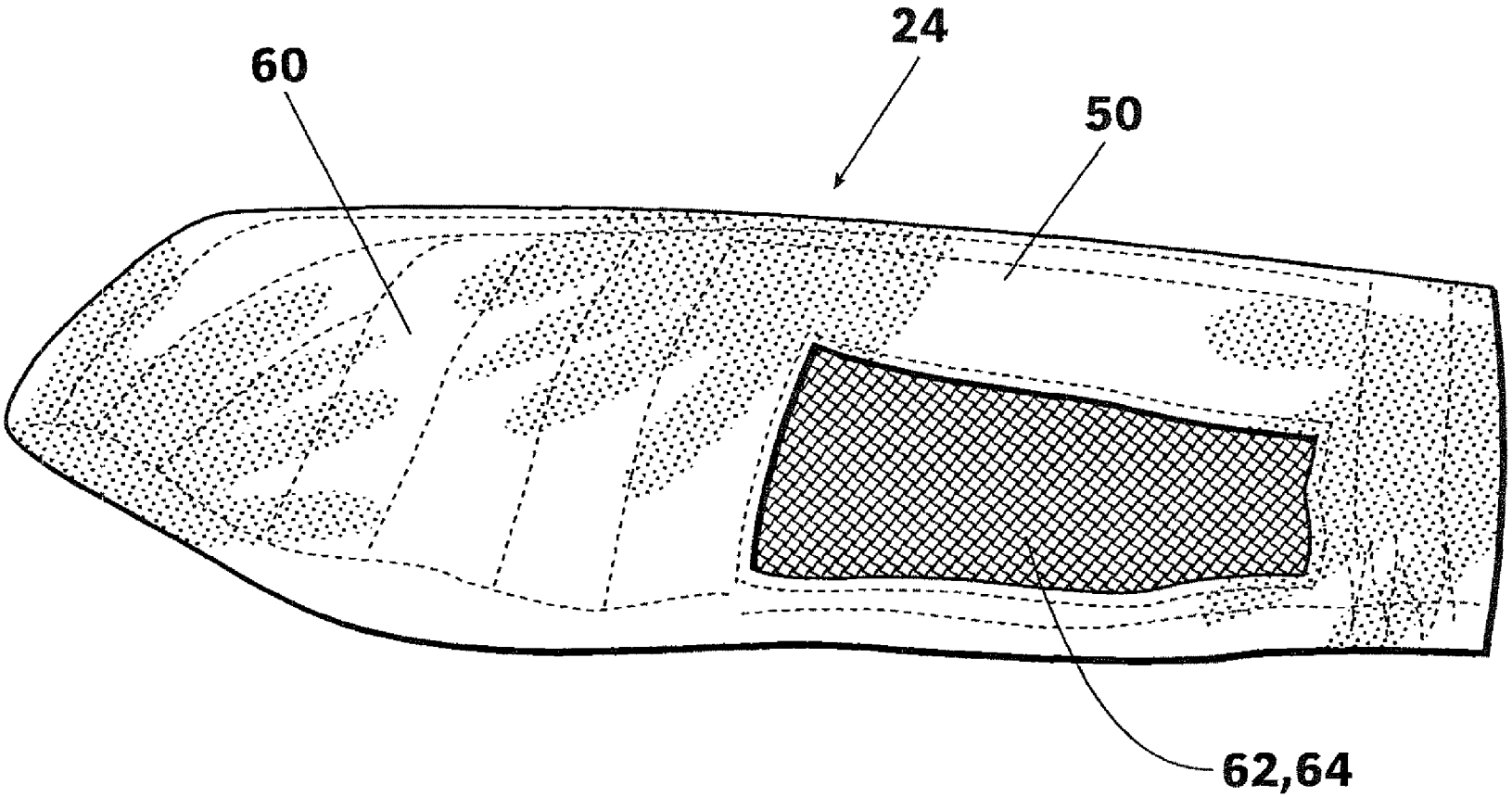
FIG. 11 is a back view of a lower arm ballistic protection material insert 24 for the upper extremity protection system 4.
Figure 12:
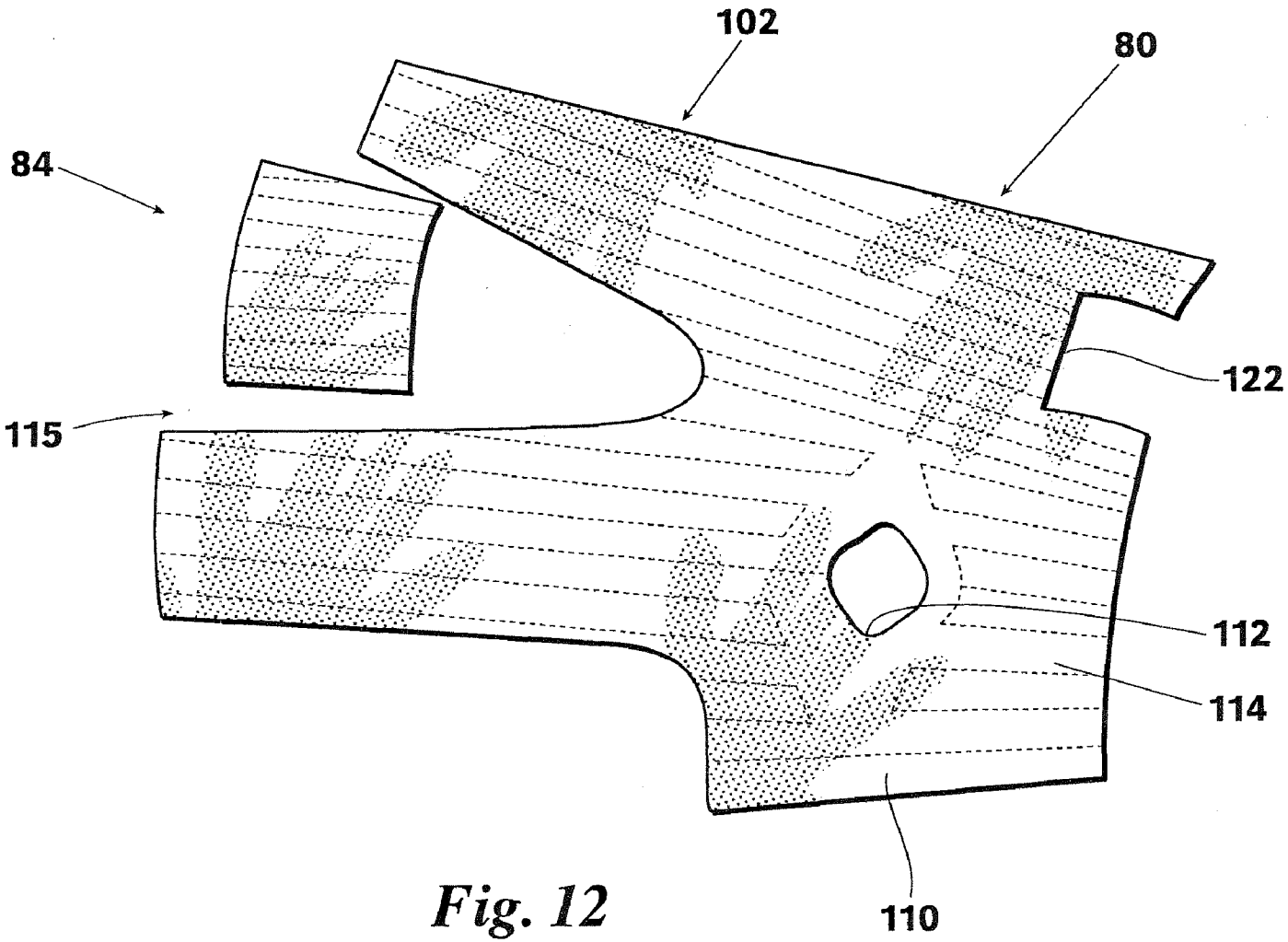
FIG. 12 shows a leg ballistic protection material insert 80 and a leg flap ballistic protection material insert 84 for the lower extremity protection system 6.
Figure 14:
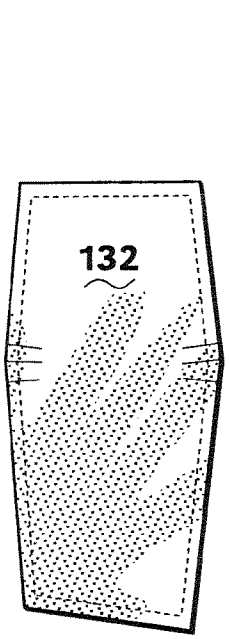
FIG. 14 shows a back knee flap cover pattern 132 for the lower extremity protection system 6.
Figure 13:
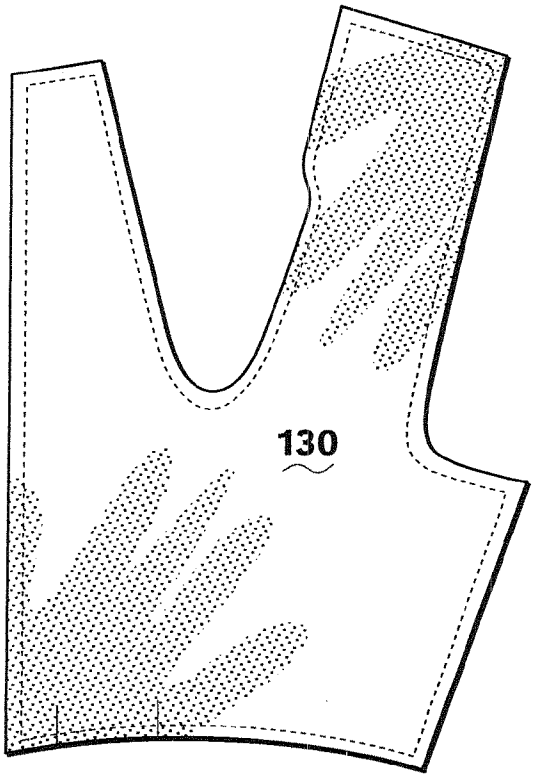
FIG. 13 shows a leg cover fabric pattern 130 for the lower extremity protection system 6.
Figure 15:
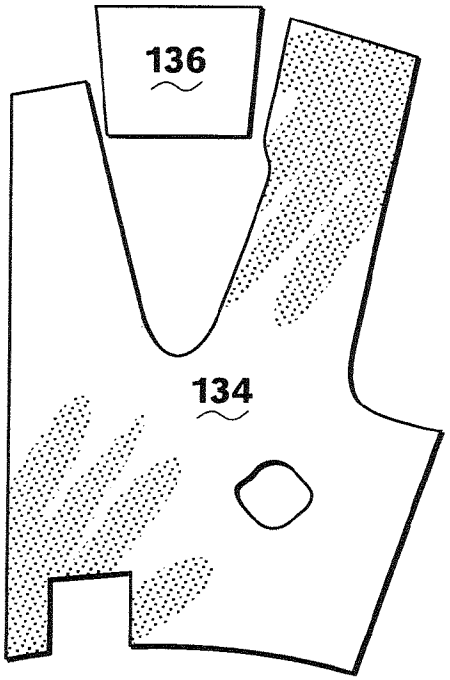
FIG. 15 shows a leg ballistic material pattern 134 and a back leg flap ballistic material pattern 136 for the lower extremity protection system 6.
Figure 17:
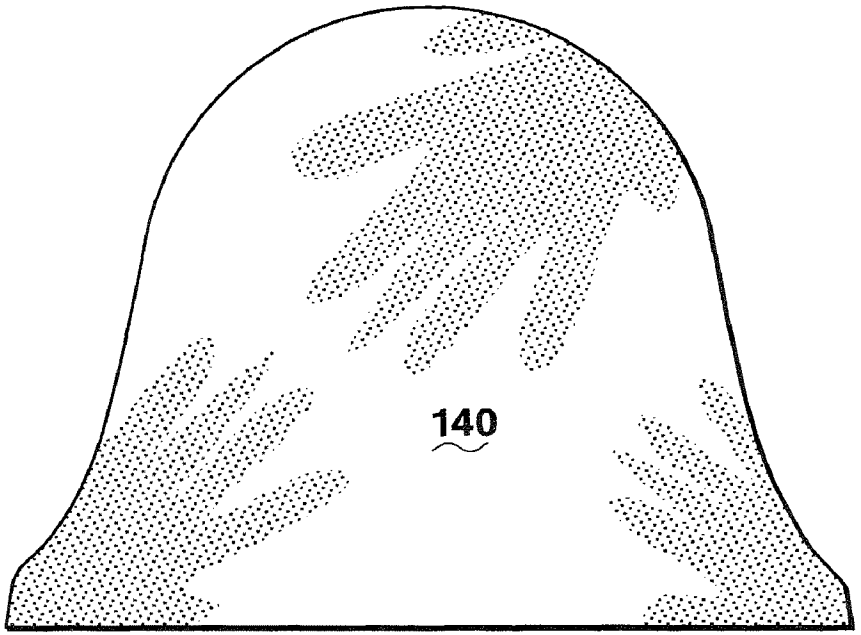
FIG. 17 shows an upper arm ballistic material pattern 140 for the upper extremity protection system 4.
Figure 16:
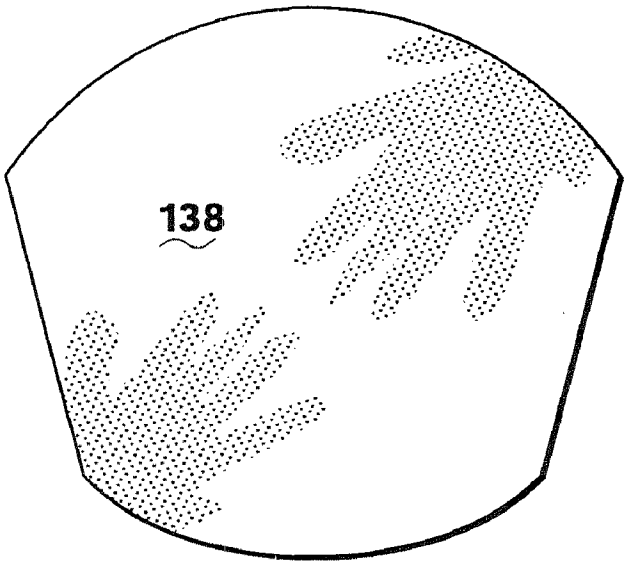
FIG. 16 shows a shoulder ballistic material pattern 138 for the upper extremity protection system 4.
Figure 19:
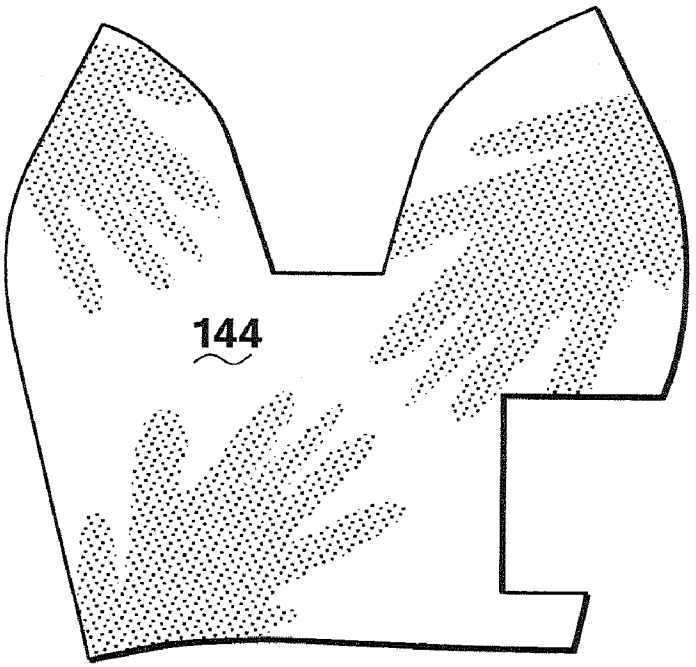
FIG. 19 shows a pattern 144 for the flanged layers of the lower arm ballistic insert 24.
Figure 18:
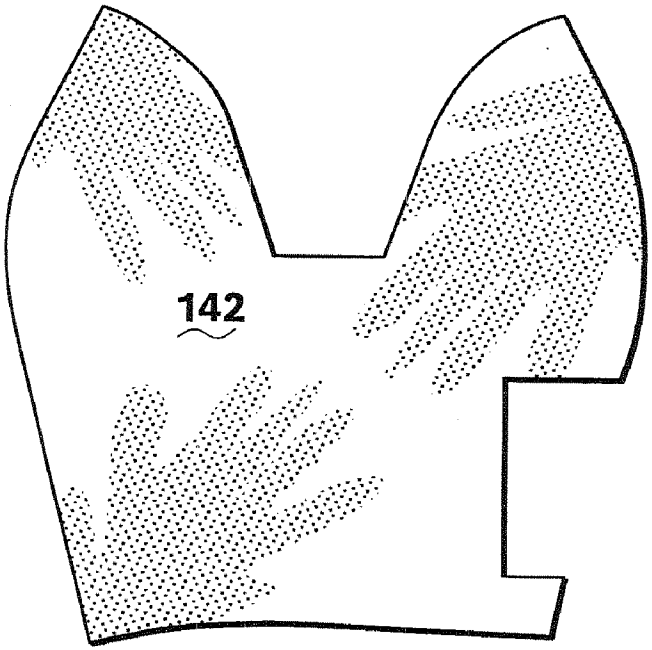
FIG. 18 shows a pattern 142 for the inner layers of the lower arm ballistic insert 24 for the upper extremity protection system 4.
Figure 22:
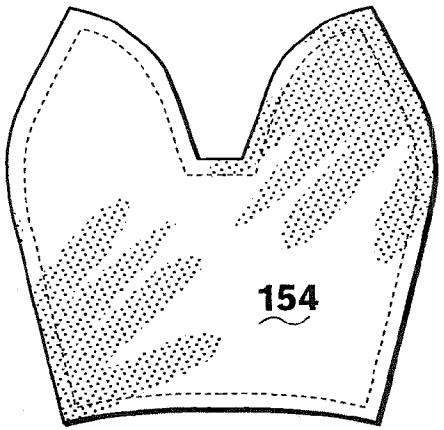
FIG. 22 shows a lower arm cover pattern 154 for the upper extremity protection system 4.
Figure 21:
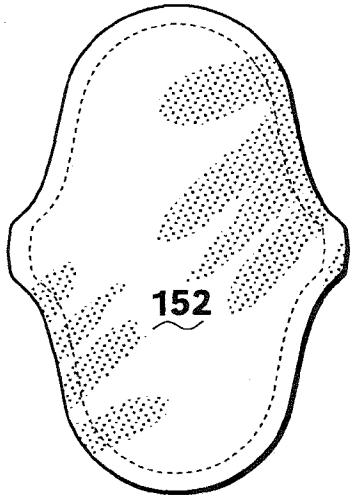
FIG. 21 shows an upper arm cover pattern 152 for the upper extremity protection system 4.
Figure 20:
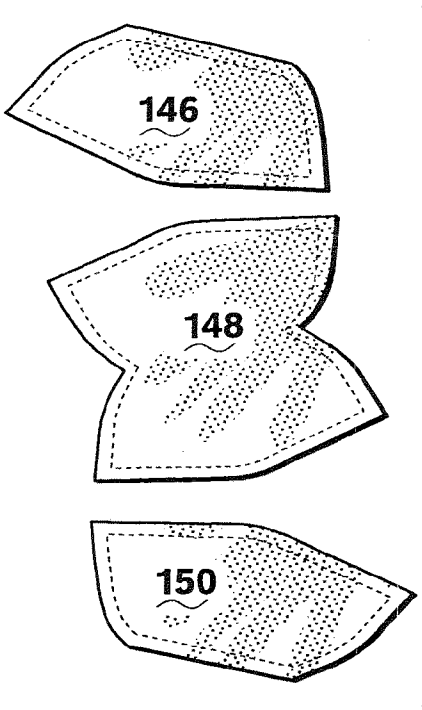
FIG. 20 shows a shoulder back cover pattern 146, a shoulder front cover pattern 148 and a shoulder back cover pattern 150 for the upper extremity protection system 4.
Figure 26:
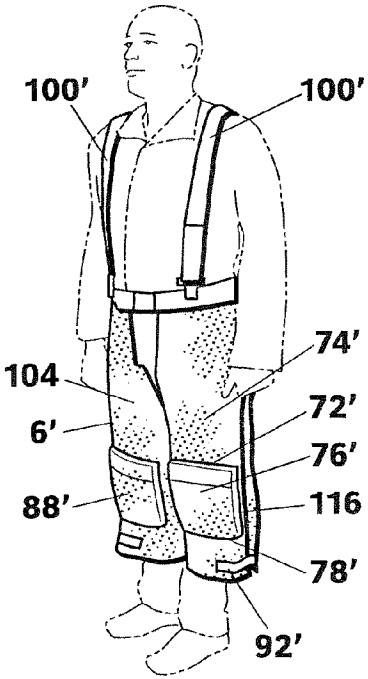
FIG. 26 is an elevational view of the lower extremity protection system 6' of embodiment 2.
Figure 25:
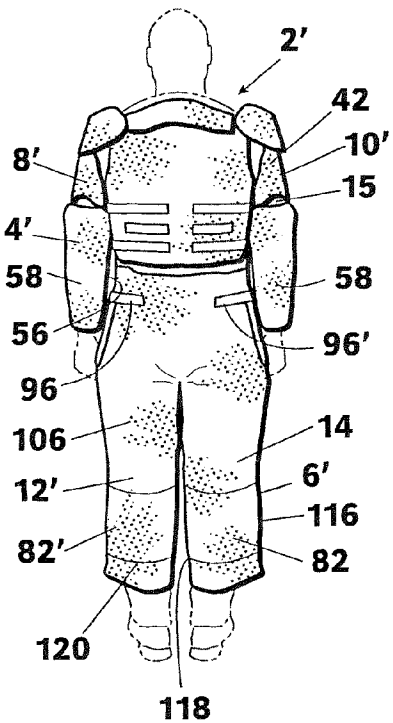
FIG. 25 is a back view of the inventive extremity armor system 2.
Figure 24:
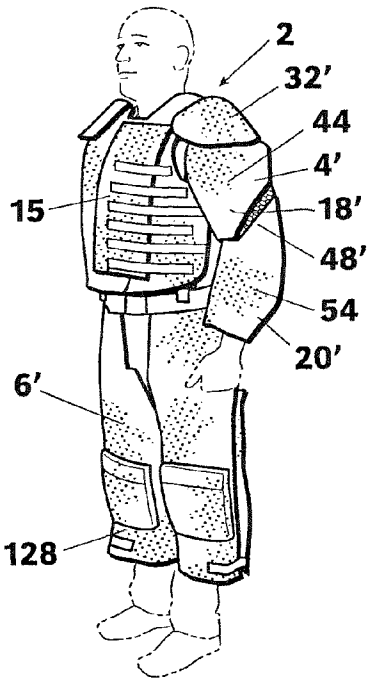
FIG. 24 is a ¾ side view of the inventive extremity armor system 2.
Figure 23:
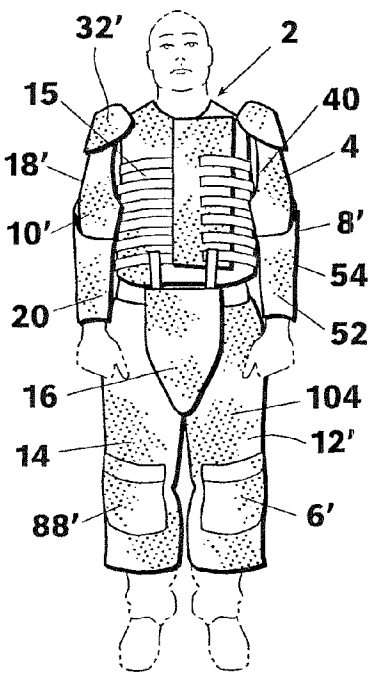
FIG. 23 is a front view of an embodiment 2 of the inventive extremity armor system and assembly which includes an upper extremity protection system 4' and a lower extremity protection system 6'.
Figure 28:
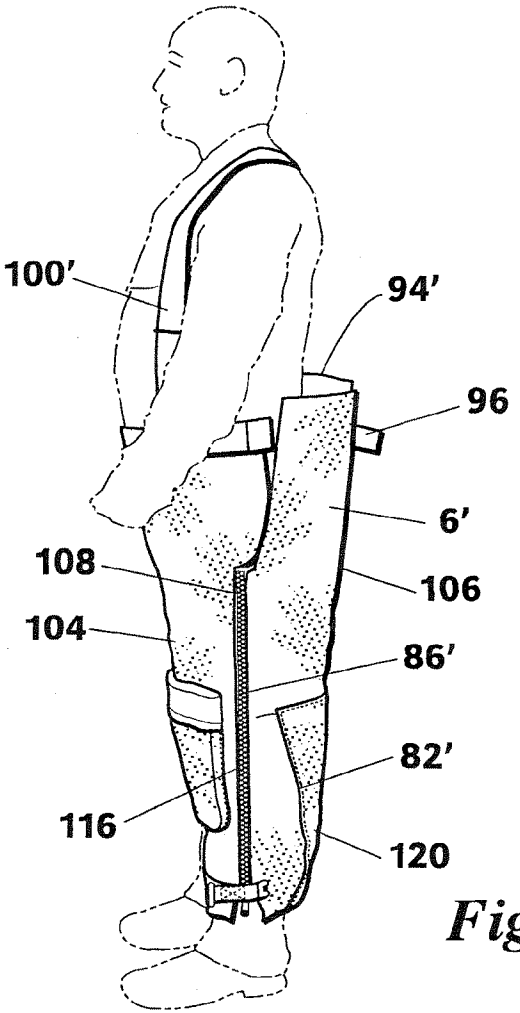
FIG. 28 is a side view of the lower extremity protection system 6' wherein the upper leg side flap 94' thereof is open.
Figure 27:
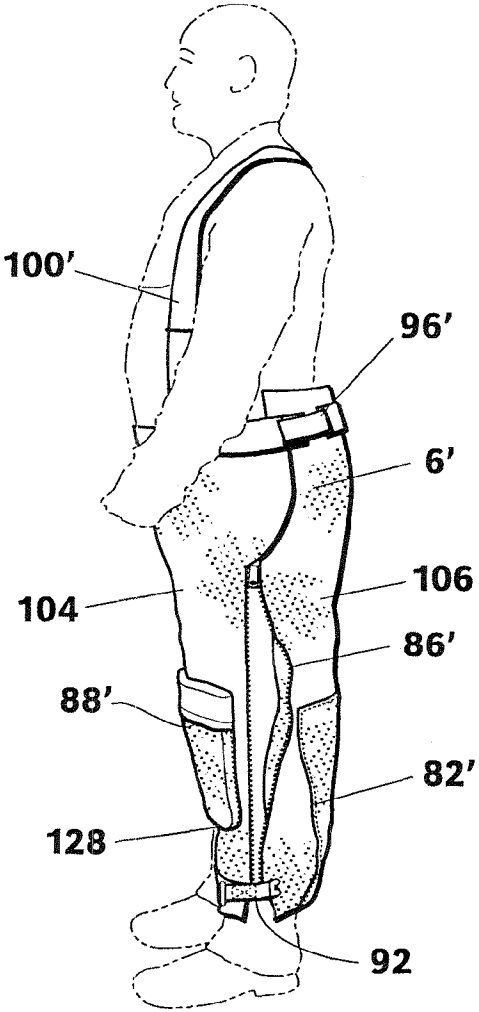
FIG. 27 is a side view of the lower extremity protection system 6' wherein the leg side zipper 86' thereof is open.
Figure 31:
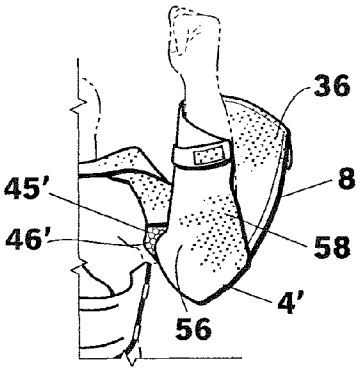
FIG. 31 shows the arm protection unit 8' with the lower arm vent 36' open.
Figure 30:
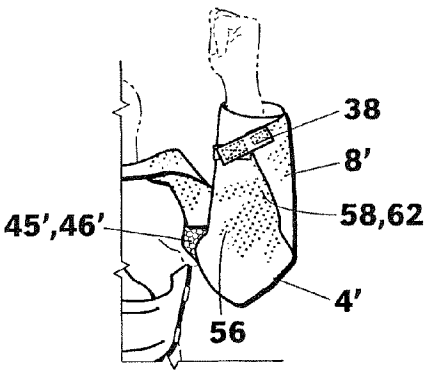
FIG. 30 shows an arm protection unit 8' of the upper extremity protection system 4' wherein the lower arm vent 36' thereof is closed.
Figure 32:
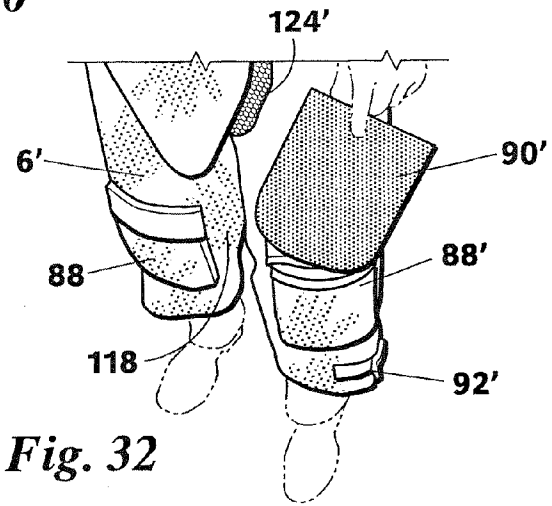
FIG. 32 is a perspective view of the lower extremity protection system 6' with one of the knee pads 90' removed.
Figure 29:
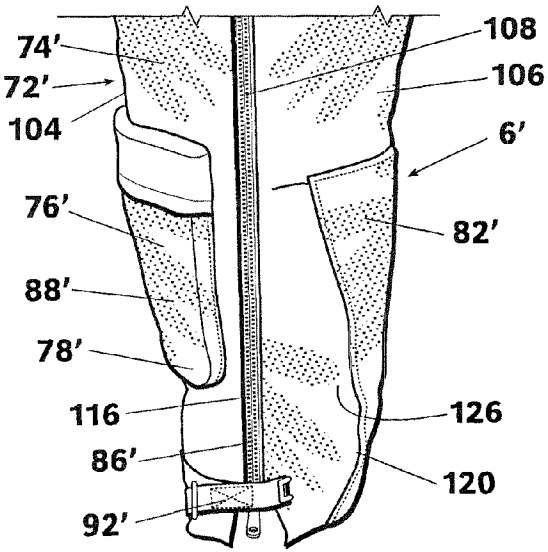
FIG. 29 is another side view of the lower extremity protection system 6' including the leg flap system.
Figure 33:
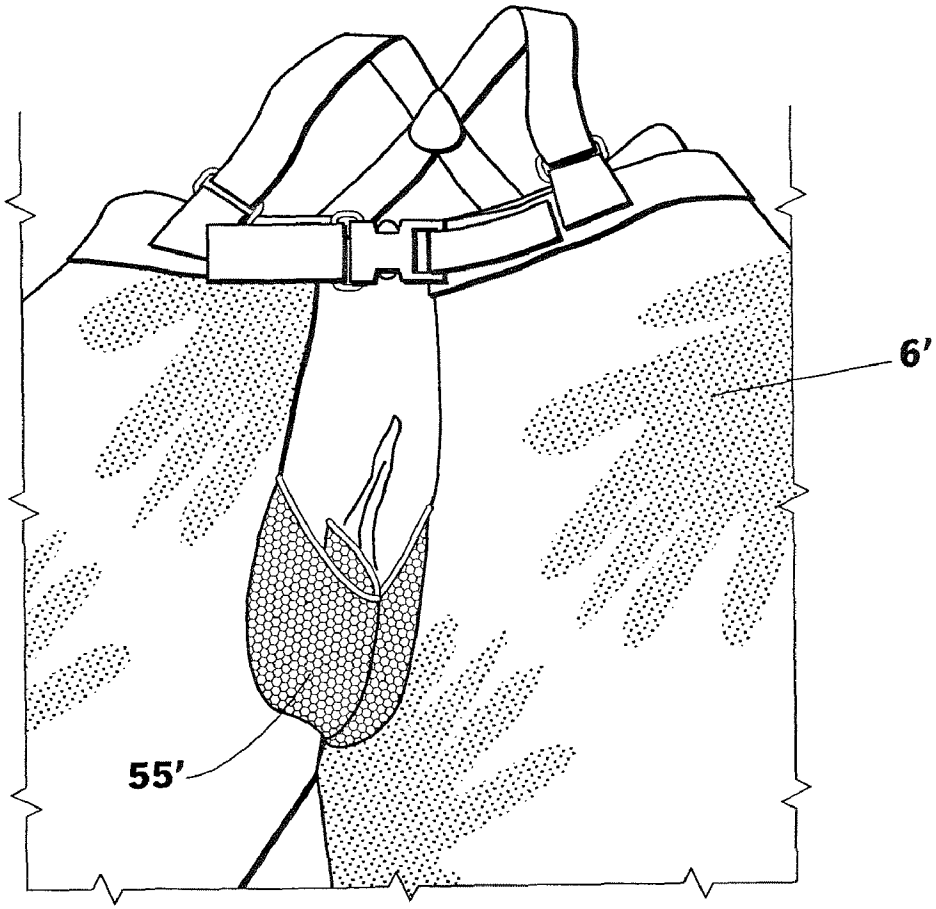
FIG. 33 is another view of the lower extremity protection system 6' showing a mesh crotch vent 55'.
Figure 34:
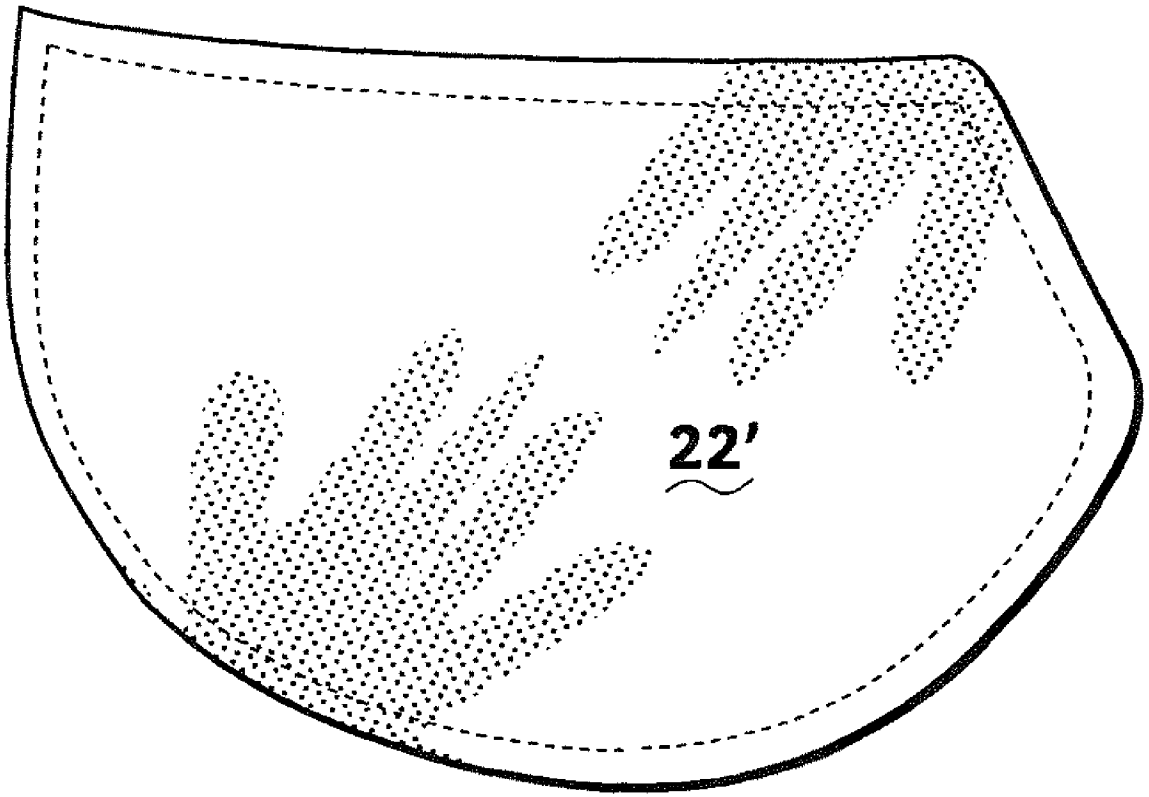
FIG. 34 shows a shoulder ballistic insert 22' for the upper extremity protection system 4'.
Figure 35:
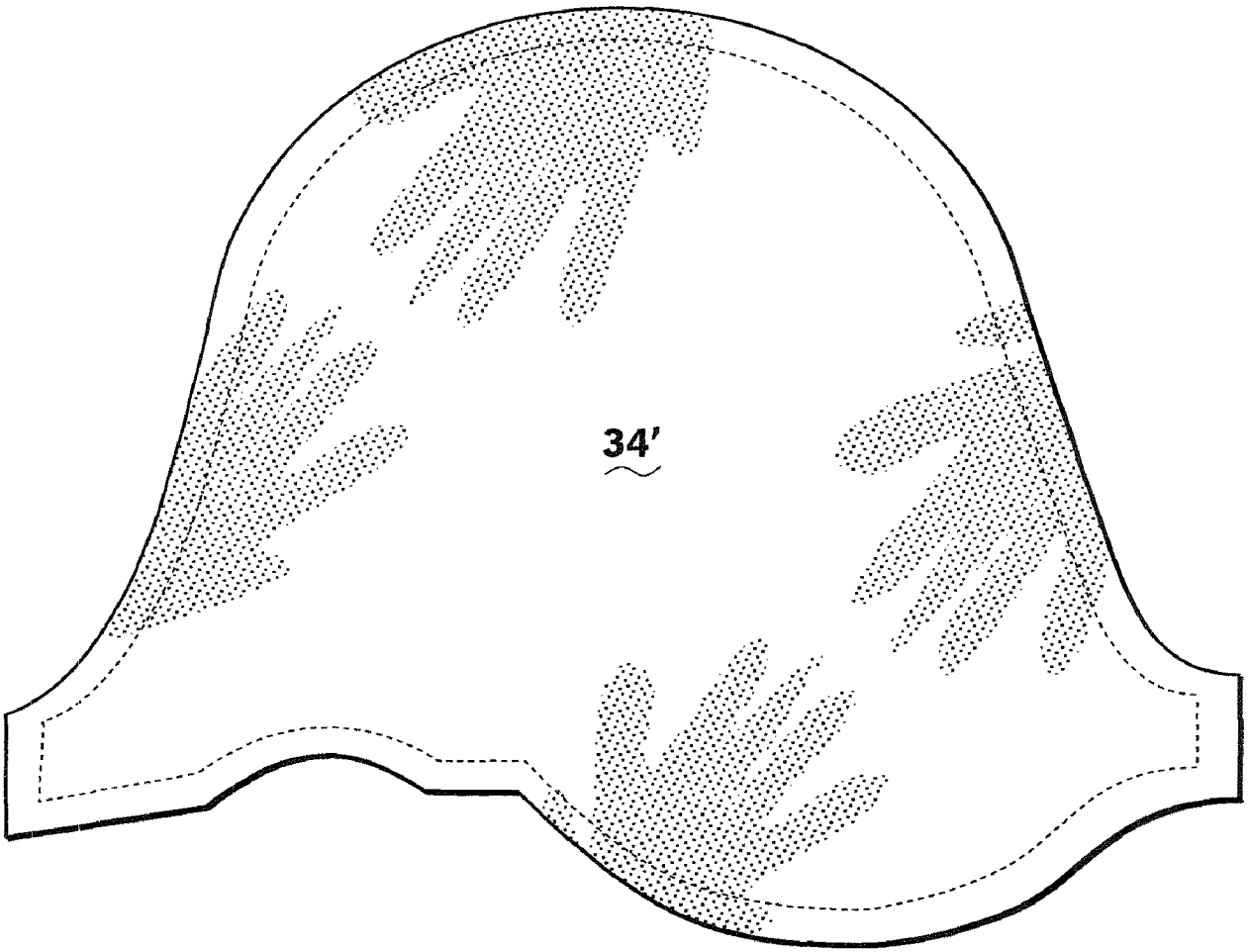
FIG. 35 shows an upper arm ballistic insert 34' for the upper extremity protection system 4'.
Figure 37:
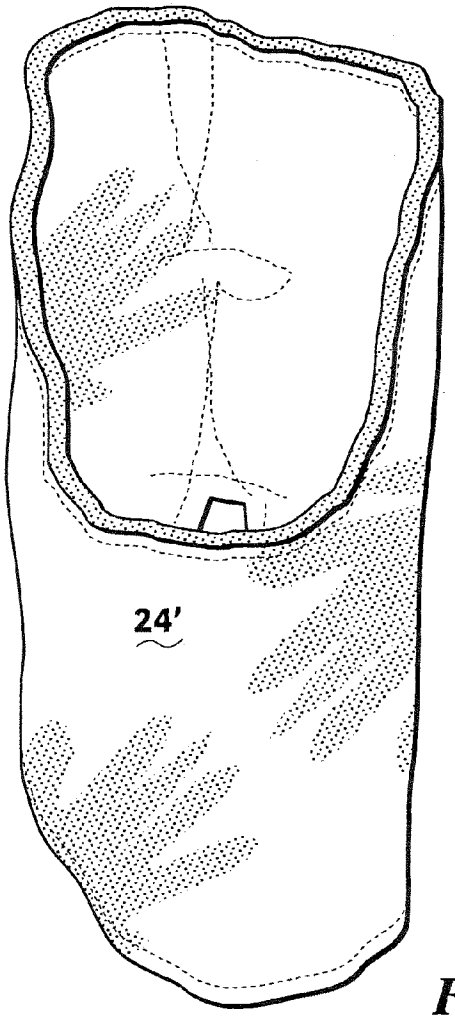
FIG. 37 is a top view of the lower arm ballistic insert 24'.
Figure 36:
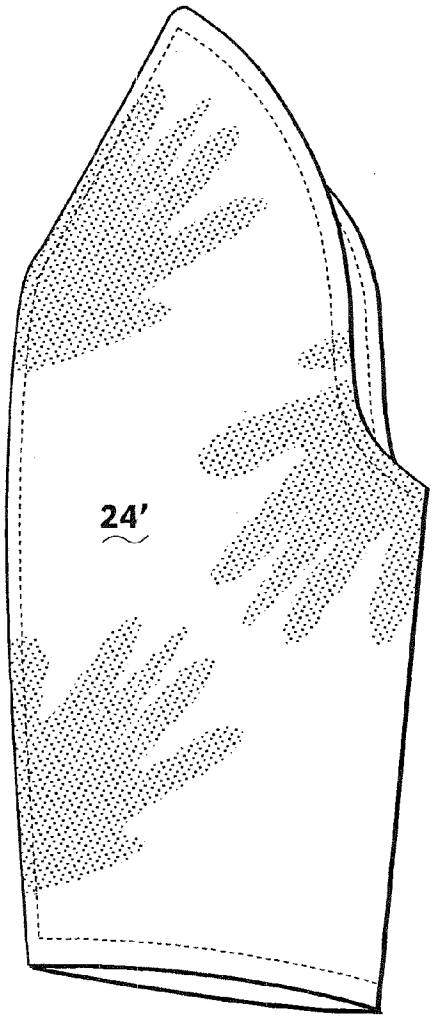
FIG. 36 is a side view of a lower arm ballistic insert 24' for the upper extremity protection system 4'.
Figure 38:
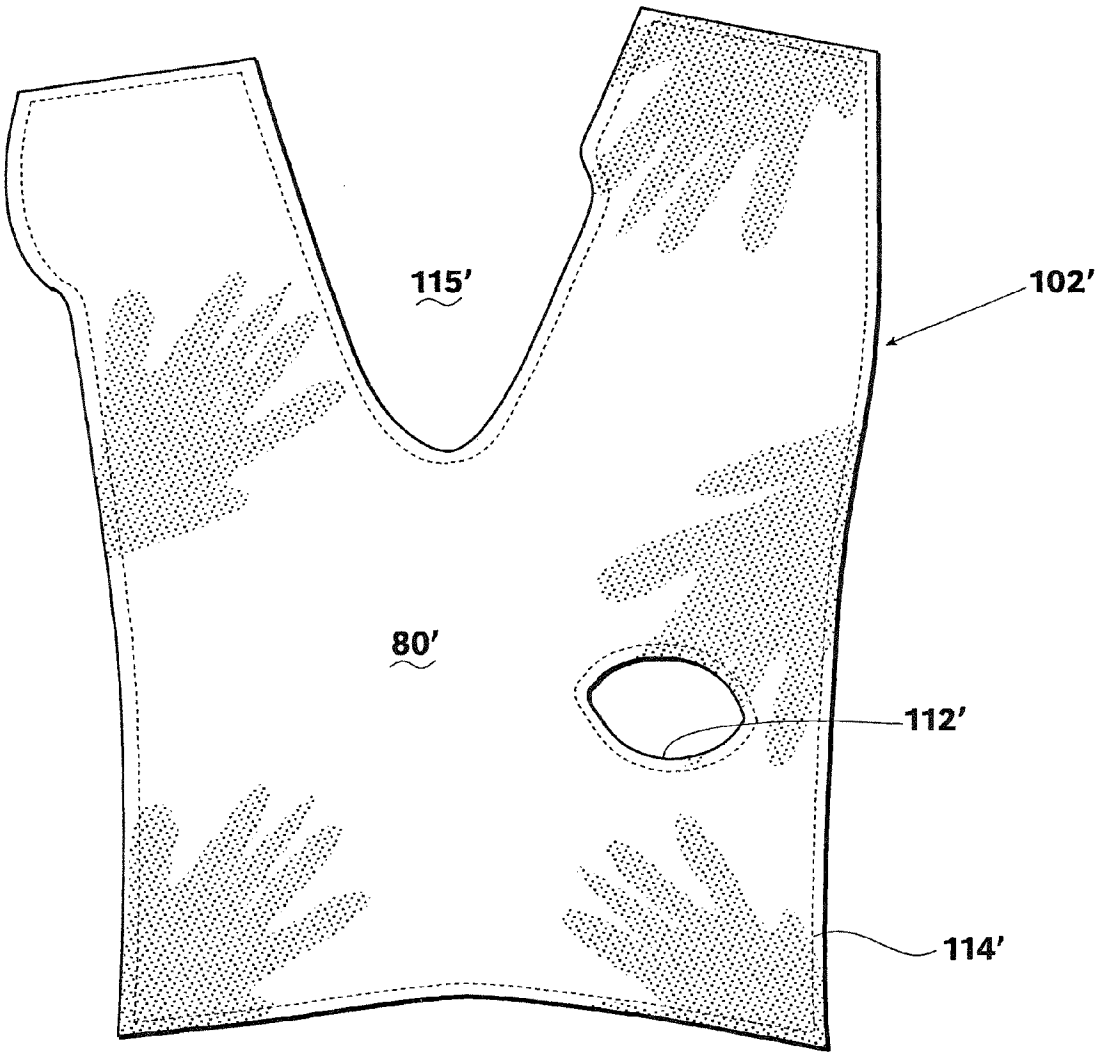
FIG. 38 shows a leg ballistic insert 80' for the lower extremity protection system 6'.
Figure 39:
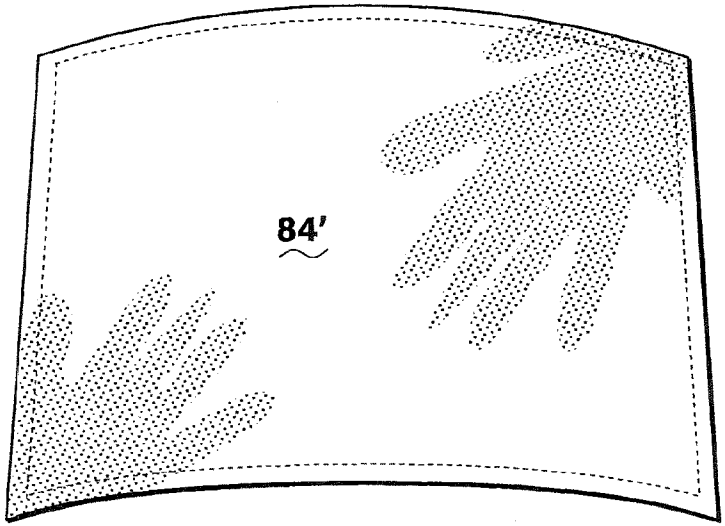
FIGS. 39 and 40 show an outwardly contoured back flap ballistic insert 84' for the lower extremity protection system 6'.
Figure 40:
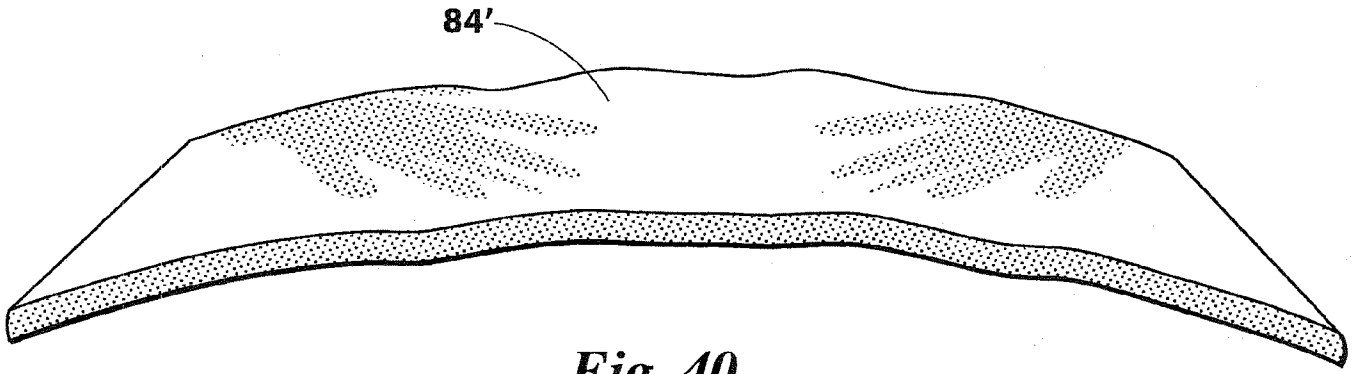
Figure 41:
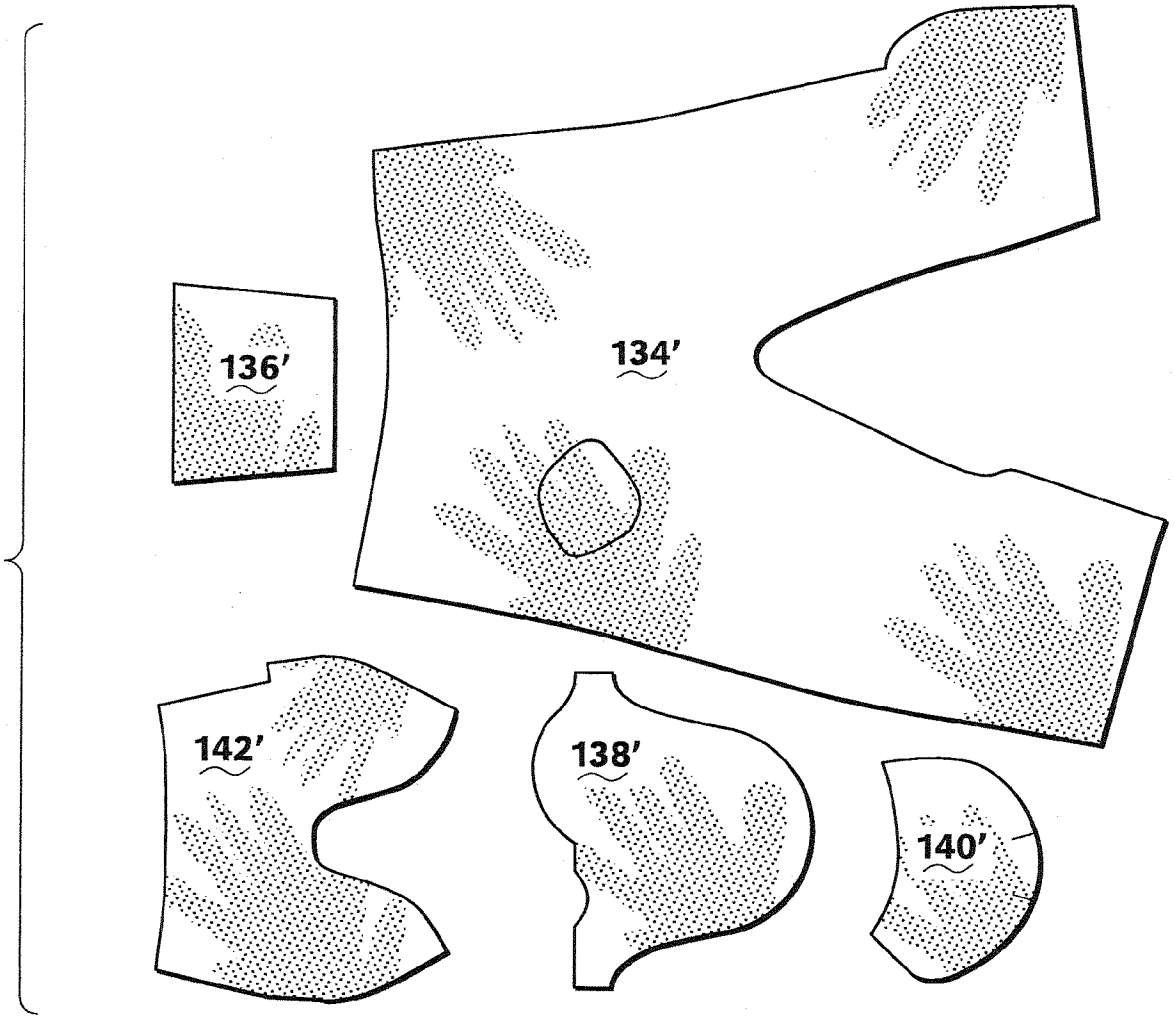
FIG. 41 shows various ballistic insert patterns for the upper extremity protection system 4' and the lower extremity protection system 6'.
Figure 42:
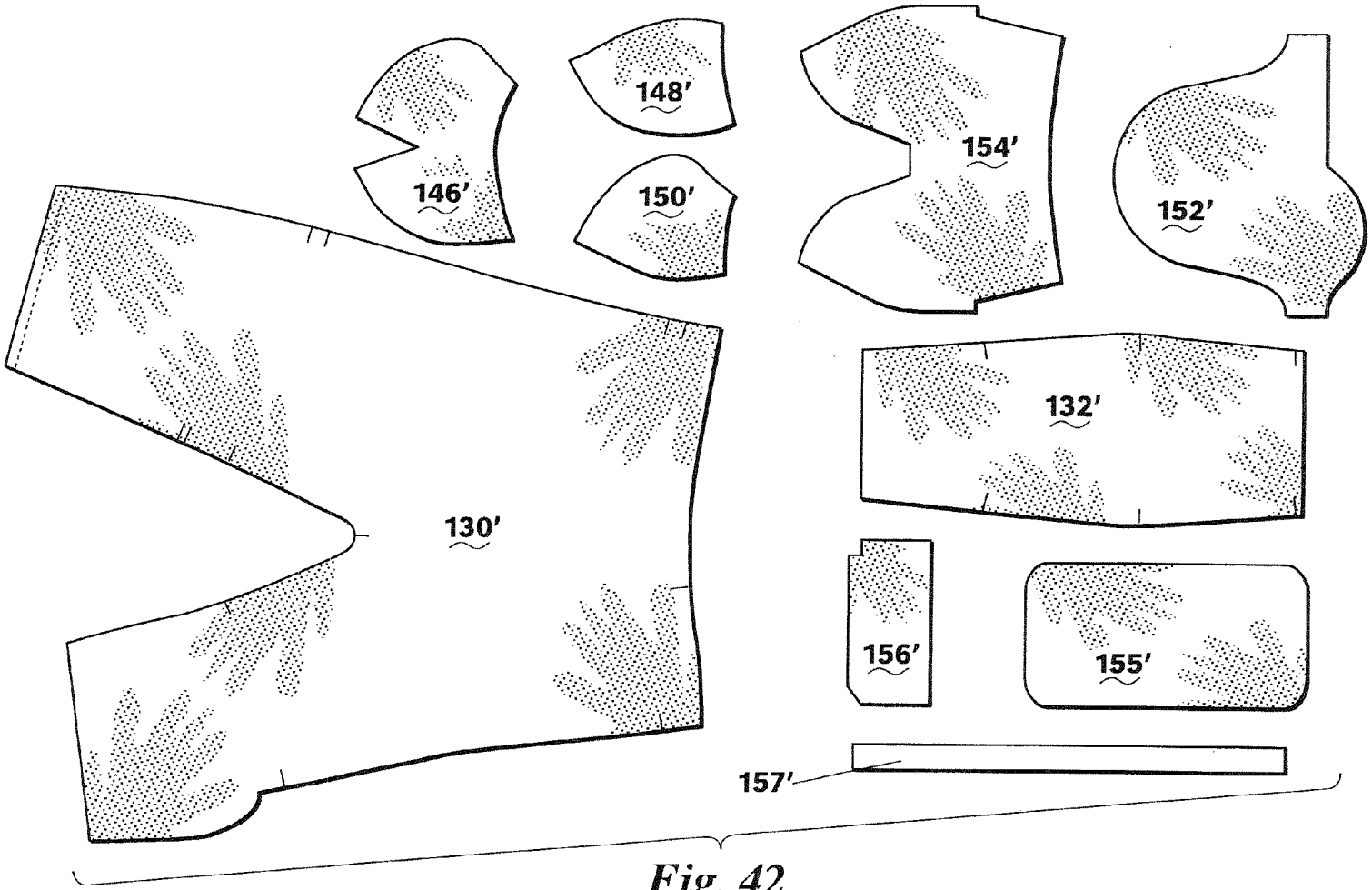
FIG. 42 shows various cover patterns for the upper extremity protection system 4' and the lower extremity protection system 6'.
Figure 43:
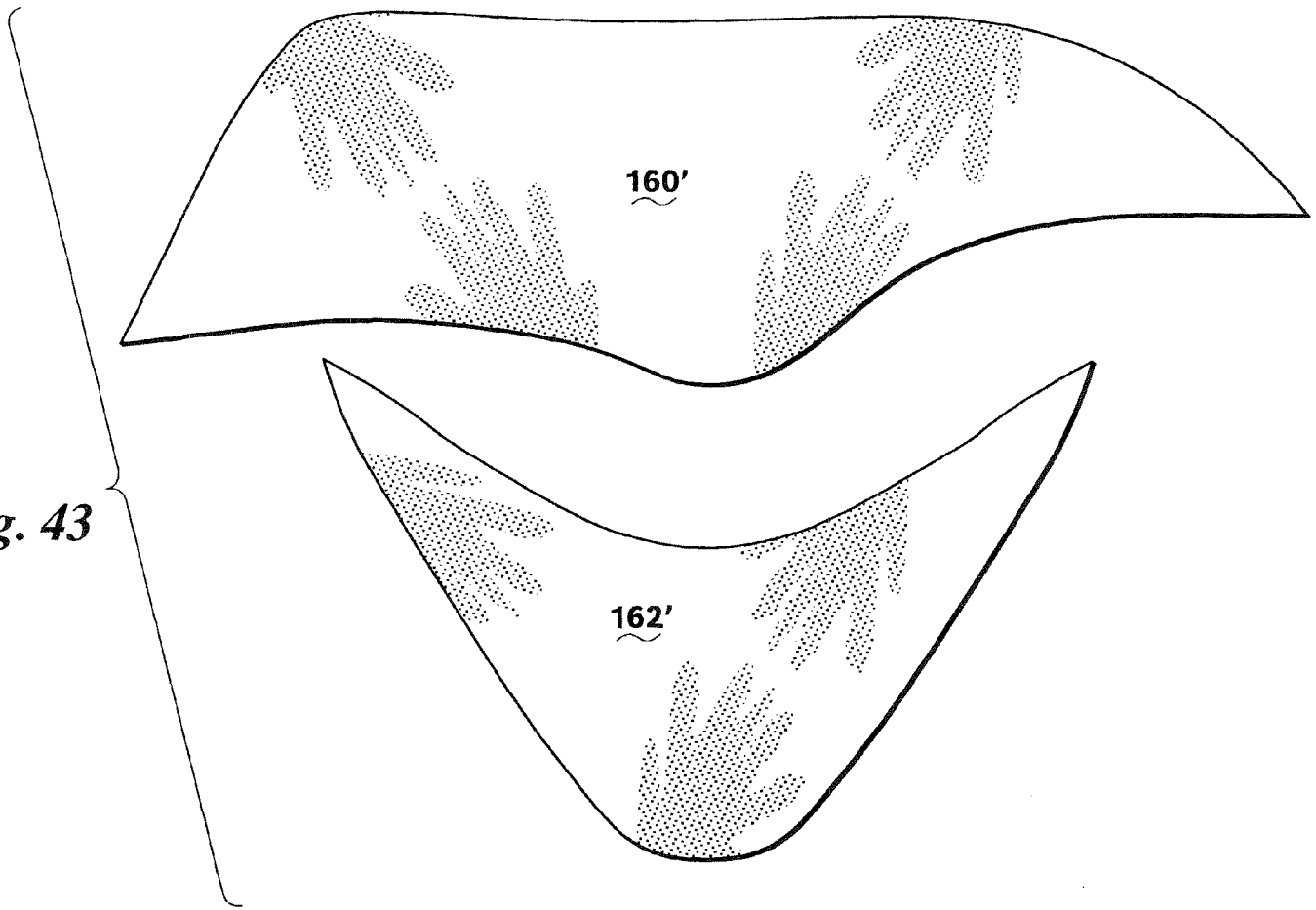
FIG. 43 shows an elbow mesh vent pattern 160' and a crotch mesh vent pattern 162' for the inventive system 2.

An embodiment 1 of the inventive extremity armor protection system comprising an upper extremity protection system 4 and a lower extremity protection system 6 is depicted in FIGS. 1-22. An alternative embodiment 2 of the inventive system comprising a somewhat different upper extremity protection system 4' and a somewhat different lower extremity protection system 6' is depicted in FIGS. 23-43. In each embodiment 1 or 2, the upper extremity system 4 or 4' comprises a left arm protection unit 8 or 8' and a right arm protection unit 10 or 10'. The lower extremity protection system 6 or 6' is preferably a pant system comprising a left leg protection unit 12 or 12' and a right leg protection unit 14 or 14'. The inventive body armor system will preferably be worn in a combination with an outer tactical vest 15 which can also include a groin protector 16.

Each of the arm protection units 8, 8' and 10, 10' is preferably a fabric sleeve system comprising: an upper arm sleeve section 18 or 18'; a lower arm sleeve section 20 or 20' which extends from the upper sleeve section 18 or 18'; an upper arm ballistic protection material insert 34 or 34' which is held in the upper sleeve section 18 or 18'; a lower arm ballistic protection material insert 24 or 24' which is held in the lower sleeve section 20 or 20'; and a shoulder protection flap 32 or 32' having a ballistic material insert 22 or 22' therein and providing a flexible shoulder joint. As further illustrated in embodiment 1, the arm protection units can include attachment features such as: an upper rear attachment strap 26; an upper epaulet attachment loop 28; and an upper front attachment strap 30. In addition, as illustrated in embodiment 2, the arm protection units can include an openable lower arm vent 36' with releasable hook and loop (e.g., Velcro®) attachment straps 38.

The upper arm ballistic insert 34 or 34' of the upper arm section 18 or 18' preferably covers the front 40, back 42, and outer side 44 of the user's arm but does not extend over the inner portion of the upper arm. The inner portion of the upper arm section 18 or 18' includes an upper arm ventilation zone 46 or 46' which does not include any ballistic protection material and is preferably formed of a mesh or perforated fabric 45 or 45'.

Although the lower sleeve section 20 or 20' of the arm protection unit can be connected to or integrally formed with the upper sleeve section 18 or 18', the lower arm ballistic insert 24 or 24' is preferably separate from the upper arm ballistic insert 22 or 22' so that a flexible elbow joint 48 or 48' is provided. The lower arm ballistic insert 24 or 24' preferably also includes a portion 60 or 60' which will fully encircle the elbow region of the user's arm.

In embodiment 2, the lower arm ballistic insert 24' preferably extends 360 degrees around the user's lower arm.

In embodiment 1, the lower arm ballistic insert 24 includes a first portion 50 which extends over the front 52, the outer side 54, and the inner side 56 of the user's lower arm but does not extend over the back 58 of the lower arm. The lower arm section 20 of embodiment 1 thus includes a lower arm ventilation zone 62 which does not include any ballistic material. The lower arm ventilation zone 62 of embodiment 1 is most preferably provided by forming a ventilation cutout 64 in the lower arm ballistic insert 24.

The use of the upper extremity protection system 4 of embodiment 1 with an outer tactical vest 15 is illustrated in FIGS. 5-8. The upper arm protection units 8 and 10 of embodiment 1 can be conveniently attached to the outer tactical vest 15 by: (a) sliding the vest epaulets 66 through the arm protection unit epaulet attachment loops 28 and snapping; (b) inserting the arm protection unit front attachment straps 30 through the utility strip slots 68 provided on the front of the vest 15; (c) looping the front attachment straps 30 back and snapping; (d) inserting the arm protection unit rear attachment straps 26 through the top emergency extraction strap 70 on the back of the vest 15; and (e) looping the rear attachment straps 26 back and snapping.

In embodiments 1 and 2, each of the left and right leg protection units 12 or 12' and 14 or 14' of the inventive system preferably comprises: a fabric pant leg 72 or 72' having an upper leg portion 74 or 74', a knee portion 76 or 76', and a lower leg portion 78 or 78'; a ballistic material insert 80 or 80' which is held in the pant leg 72 or 72'; a back flap 82 or 82' extending vertically, when the user is standing, over the back of the user's knee; a ballistic material insert 84 or 84' which is held in the back flap 82 or 82' such that the insert 84 or 84' will cover the back of the user's knee when standing; and a two-way side zipper 86 or 86'. The lower extremity protection system 6 or 6' can also include suspenders 100 or 100'. The lower extremity protection system 6' of embodiment 2 further comprises: an optional front knee pad pocket 88' having a removable knee pad 90' positioned therein; an outer lower hook and loop (e.g., Velcro®) tie down 92'; an openable upper leg side flap 94'; and a releasable hook and loop strap 96' for closing the upper side flap 94'.

The ballistic material insert 80 for each of the leg protection units 12 and 14 of embodiment 1 includes: an upper portion 102 which covers at least the front portion 104 and the back portion 106 of the user's upper legs but does not extend over the inner portion of the upper leg; a knee portion 110 which will extend around the knee region of the user's leg but includes a cutout 112 which will be positioned on the back of the user's knee to provide flexibility for squatting, running, climbing, etc.; and a lower leg portion 114 which will extend over the outer side 116, the inner portion 118, and the back 120 of the user's lower leg but includes a ventilation cutout 122 which will be positioned on the front of the lower leg over the user's shin bone.

The ballistic material insert 80' for each of the leg protection units 12' and 14' of embodiment 2 is similar to insert 80 except that (a) the upper portion 102' of the embodiment 2 insert 80' will extend over at least most of the outer side 108 of the user's upper leg when the upper leg side flap 94' is closed and (b) the lower leg portion 114' will preferably extend 360 degrees around the lower leg.

In each of embodiments 1 and 2, the upper open area 115 or 115' in the leg ballistic insert 80 or 80' provides an upper leg ventilation zone 124 or 124' which will be positioned on the inner portion of the user's upper leg adjacent to the user's other leg. The upper leg ventilation zone 124 or 124' is preferably formed of a mesh or perforated fabric material. In addition, as indicated above, the knee cut out 112 or 112' provided in each leg insert 80 or 80' will be covered or shadowed by the back flap ballistic insert 84 or 84'. However, for ease of movement and flexibility, the back flap and the flap insert 84 or 84' will automatically slide downwardly when the user squats or kneels. The back flap ballistic inserts 84 or 84' also preferably have an outwardly bowed or contoured shape to facilitate this sliding movement. The back flap inserts, shoulder inserts, and other insert pieces of the various embodiments are also preferably sewn together in a contoured manner as shown in the drawings to correspond with the shape of the body and thus provide better fit, comfort and protection.

In regard to embodiment 1 of the inventive system, the accompanying figures also show: a leg cover fabric pattern 130; a back knee flap cover pattern 132; a pattern 134 for the leg ballistic insert 80; a pattern 136 for the back leg flap ballistic insert 84; a pattern 138 for the upper arm ballistic insert 34; a pattern 140 for the shoulder ballistic insert 22; a pattern 142 for the inner layers of the lower arm ballistic insert 24; a pattern 144 for the two larger flanged layers of the lower arm ballistic insert 24; a shoulder back cover pattern 146; a shoulder front cover pattern 148; a shoulder back cover pattern 150; an upper arm cover pattern 152; and a lower arm cover pattern 154.

In regard to embodiment 2 of the inventive system, the accompanying figures also show: a leg cover fabric pattern 130'; a back knee flap cover pattern 132'; a pattern 134' for the leg ballistic insert 80'; a pattern 136' for the leg flap ballistic insert 84'; a pattern 138' for the upper arm ballistic insert 34'; a pattern 140' for the shoulder ballistic insert 22'; a pattern 142' for the lower arm ballistic insert 24'; shoulder cover patterns 146', 148', and 150'; an upper arm cover pattern 152'; a lower arm cover pattern 154'; pocket patterns 155', 156', and 157'; a mesh pattern 160' for the arm mesh vent 45'; and a mesh pattern 162' for a crotch mesh vent 55'.

Figure 45:
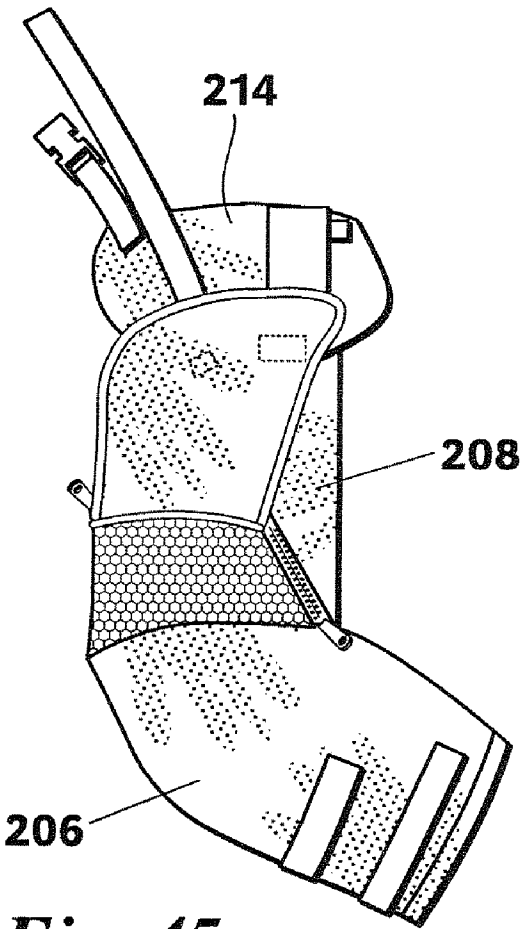
FIG. 45 is an inner side view of the arm unit of the third embodiment.
Figure 44:
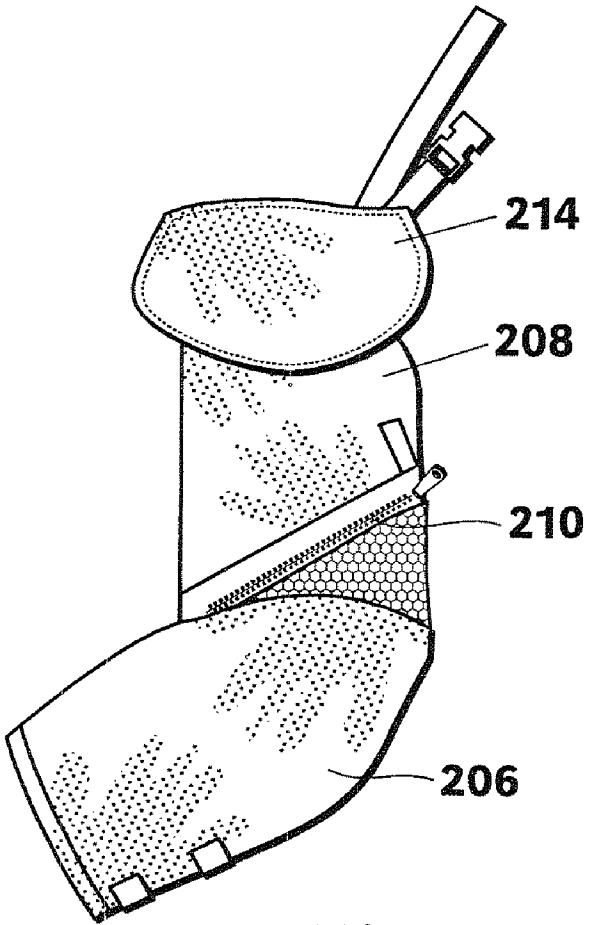
FIG. 44 is an outer view of an arm unit of a third embodiment of the inventive extremity armor system.
Figure 46:
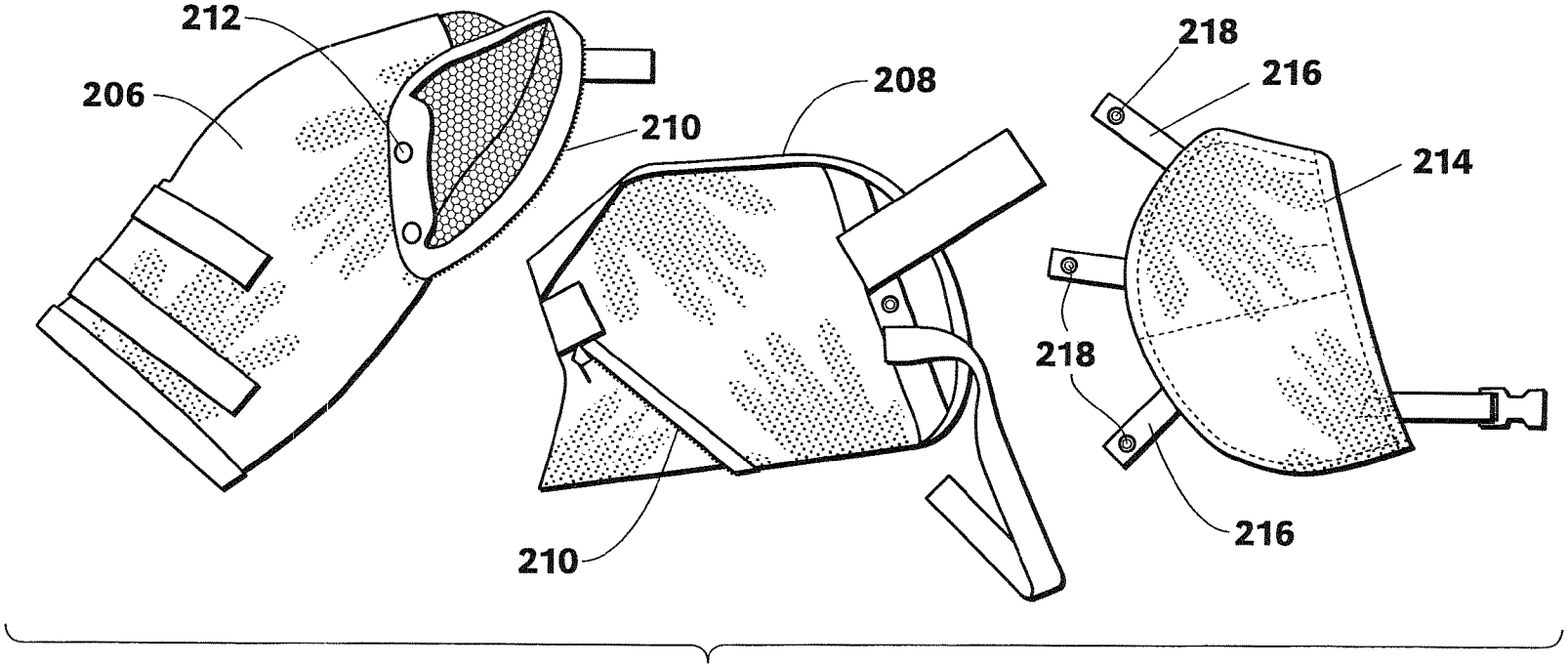
FIG. 46 is an exploded, unattached view of the arm unit of the third embodiment.
Figure 48:
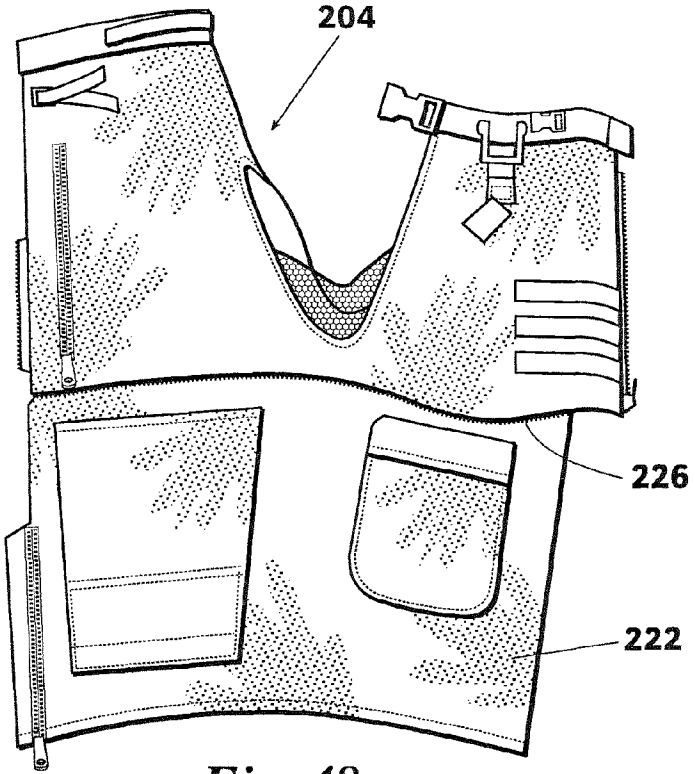
FIG. 48 is a side view of the lower extremity system 204.
Figure 47:
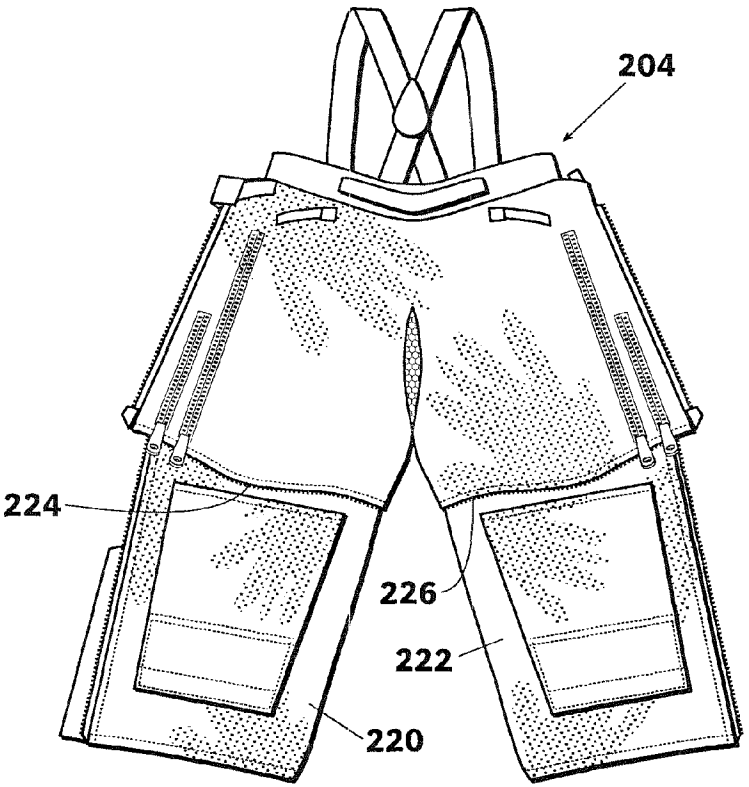
FIG. 47 is a back view of a lower extremity protection system 204 of the third embodiment.
Figure 49:
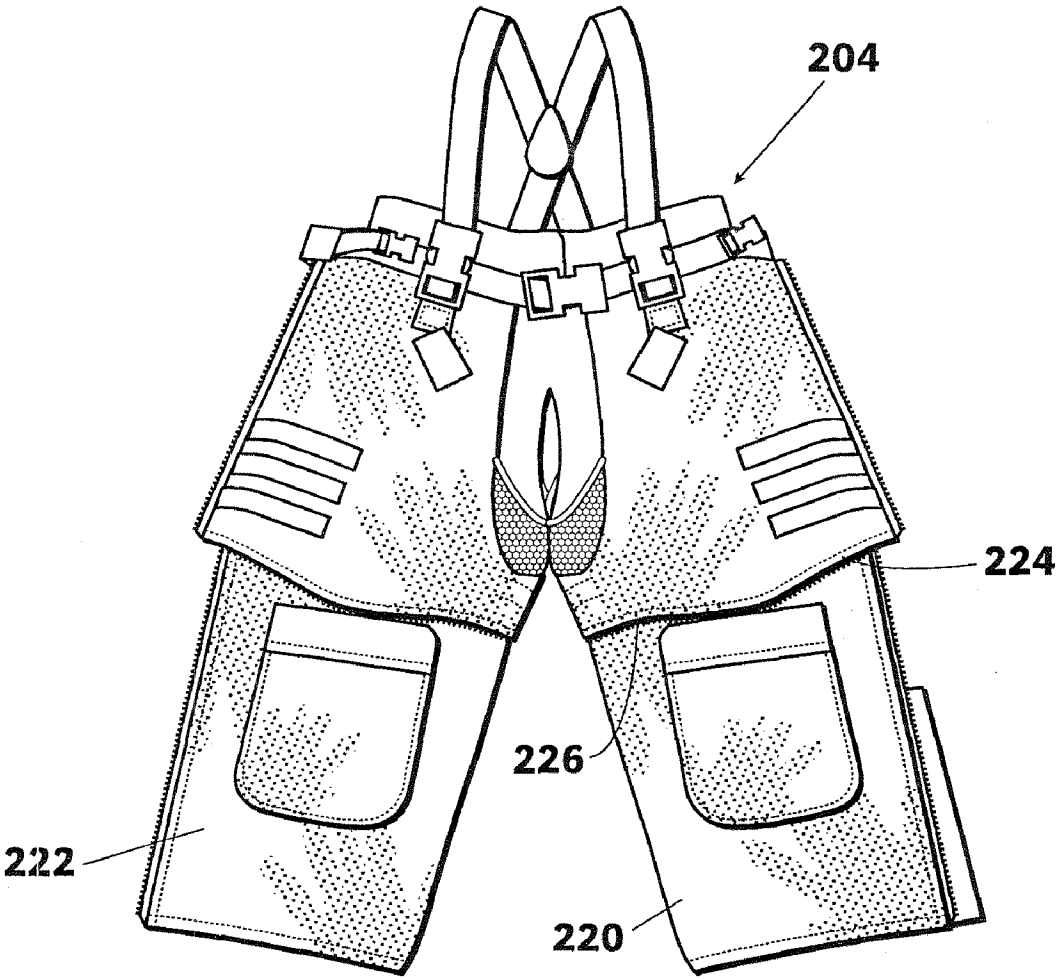
FIG. 49 is a front view of the lower extremity system 204.
Figure 50:
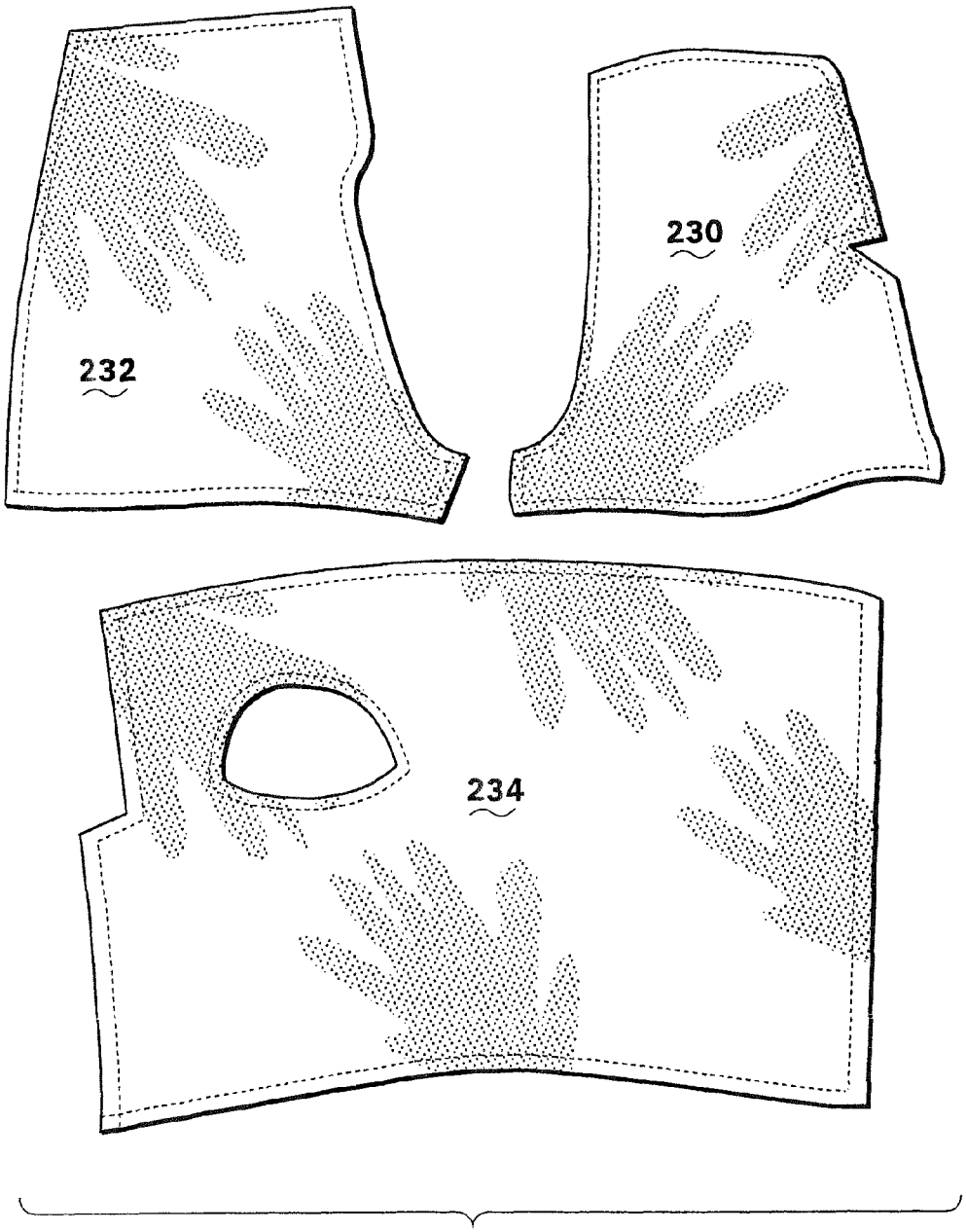
FIG. 50 shows ballistic insert pieces for the lower extremity system 204.

A third embodiment of the inventive extremity armor system is depicted in FIGS. 42-48. The third embodiment comprises an upper extremity protection system and a lower extremity protection system which are substantially similar to the upper and lower extremity protection systems 4' and 6' of embodiment 2. However, the third embodiment is different in that: the lower arm sections 206 of the upper system are detachable from the upper arm sections 208 thereof; the lower arm sections 206 are removably attachable using zippers 210, snaps 212, and/or similar attachments; the upper arm sections 208 are removably attachable to the shoulder pieces 214 using elastic tabs 216 and snaps 218 or similar attachments; each leg 220 and 222 of the lower extremity protection system 204 is removably attached above the knee by a covered zipper 224 or 226 or other attachment; and each of the leg ballistic material inserts is correspondingly divided into a front upper leg piece 230, a back upper leg piece 232, and a lower leg and knee piece 234.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the appended claims.

What is claimed is:

1. A method of reducing injury to and decreasing the probability of amputation to extremities comprising:

providing protection of vascular and nerve bundles of an upper arm, said protection comprising at least 270 degree coverage of the outside of said upper arm with a ballistic material, said protection further comprising shadowing of an inside portion of said upper arm, wherein said shadowing is positioned and configured to ventilate said upper arm;

providing protection of vascular and nerve bundles of an lower arm, said protection comprising at least 270 degree coverage of a front portion of said lower arm with a ballistic material, said protection further comprising shadowing of a back portion of said lower arm, wherein said shadowing is positioned on a back of said lower arm when said lower arm is held at the individual's side, and configured to ventilate said lower arm;

providing protection of vascular and nerve bundles of an elbow zone, said protection comprising approximately 360 degree coverage of said elbow zone with a ballistic material, wherein said coverage is configured to provide flexibility of said elbow;

providing protection of vascular and nerve bundles of an upper leg, said protection comprising at least 270 degree coverage of the outside of said upper leg with a ballistic material, said protection further comprising shadowing of an inside portion of said upper leg, wherein said shadowing is positioned and configured to ventilate said upper leg;

providing protection of vascular and nerve bundles of an lower leg, said protection comprising at least 270 degree coverage of said lower leg with a ballistic material and shadowing positioned over the shinbone and configured to ventilate said lower leg;

providing protection of vascular and nerve bundles of the knee zone, said protection comprising approximately 360 degree coverage of said knee zone with a ballistic material, wherein said coverage is configured to provide flexibility of said knee; and providing protection of the sciatic nerve extending from the lower back down the buttocks to the rear of said upper leg, said protection comprising coverage of said sciatic nerve with a ballistic material.

2. The method of claim 1 further comprising a mesh covering for said inside portion of said upper arm.

3. The method of claim 1 further comprising a mesh covering for said inside portion of said upper leg.

4. The method of claim 1, further comprising providing protection of vascular and nerve bundles of a shoulder with ballistic material.

5. The method of claim 1 wherein said protection of vascular and nerve bundles of an upper arm more preferably ranges from about 270 degrees to about 300 degrees coverage of the outside of said upper arm with a ballistic material.

6. The method of claim 1 wherein said upper leg protection more preferably ranges from about 270 degrees to about 300 degrees coverage of the outside of said upper leg with a ballistic material.

7. The method of claim 1 wherein said lower leg protection more preferably comprises about 360 degrees coverage of the outside of said upper leg with a ballistic material.

8. The method of claim 1 wherein protection is configured to be light weight.

9. The method of claim 1 wherein said protection is configured to be worn over a standard USMC Combat Utility uniform or Battle Dress Uniform.

10. The method of claim 1 wherein said protection is configured to connect to an outer tactical vest.

11. The method of claim 1 wherein said protection of said upper arm, lower arm, and elbow is configured to be removable connected to provide an arm protection unit.

12. The method of claim 9 wherein said arm protection unit is configured to be connected across an individual's back.

13. An extremity armor system for reducing injury to and decreasing the probability of amputation to extremities comprising:

an upper arm protection unit configured to provide protection of vascular and nerve bundles of an upper arm comprised of at least 270 degree coverage of the outside of said upper arm with a ballistic material, said protection unit further comprising shadowing of an inside portion of said upper arm, wherein said shadowing is positioned and configured to ventilate said upper arm;

an lower arm protection unit configured to provide protection of vascular and nerve bundles of an lower arm comprising at least 270 degree coverage of a front portion of said lower arm with a ballistic material, said protection further comprising shadowing of an back portion of said lower arm, wherein said shadowing is positioned on a back of said lower arm when said lower arm is held at the individual's side, and configured to ventilate said lower arm;

an elbow zone protection unit configured to provide protection of vascular and nerve bundles of an elbow, said protection unit comprising approximately 360 degree coverage of said elbow with a ballistic material, wherein said coverage is configured to provide flexibility of said elbow;

an upper leg protection unit configured to provide protection of vascular and nerve bundles of an upper leg, said protection unit comprising at least 270 degree coverage of the outside of said upper leg with a ballistic material, said protection further comprising shadowing of an inside portion of said upper leg, wherein said shadowing is positioned and configured to ventilate said upper leg;

a lower leg protection unit configured to provide protection of vascular and nerve bundles of a lower leg, said protection unit ranging from about 270 degrees to about 360 degrees of coverage of said lower leg with a ballistic material and comprising shadowing positioned over the shinbone and configured to ventilate said lower leg;

a knee zone protection unit configured to provide protection of vascular and nerve bundles of the knee, said protection unit comprising approximately 360 degree coverage of said knee zone with a ballistic material, wherein said coverage is configured to provide flexibility of said knee; and a sciatic nerve protection unit configured to protect the sciatic nerve extending from the lower back down the buttocks to the rear of said upper leg, said protection comprising coverage of said sciatic nerve with a ballistic material.

14. The system of claim 13 further comprising a mesh covering said inside portion of said upper arm.

15. The system of claim 13 further comprising a mesh covering said inside portion of said upper leg.

16. The system of claim 13 further comprising providing protection of vascular and nerve bundles of a shoulder with ballistic material.

17. The system of claim 13 wherein said upper arm protection unit more preferably ranges from about 270 degrees to about 300 degrees coverage of the outside of said upper arm with a ballistic material.

18. The system of claim 13 wherein said upper leg protection unit more preferably comprises about 300 degrees coverage of the outside of said upper leg with a ballistic material.

19. The system of claim 13 wherein said lower leg protection unit more preferably comprises about 360 degrees coverage of the outside of said upper leg with a ballistic material.

20. The system of claim 13 wherein protection units are configured to be light weight.

21. The system of claim 13 wherein said protection units are configured to be worn over a standard USMC Combat Utility uniform or Battle Dress Uniform.

22. The system of claim 13 wherein-said protection is configured to connect to an outer tactical vest.

23. The system of claim 13 wherein said protection units of said upper arm, lower arm, and elbow are configured to be removable connected to provide an arm protection unit.

24. The system of claim 23 wherein said arm protection unit is configured to be connected across an individual's back.

* * * * *